US009437910B2

(12) United States Patent
Hendry et al.

(10) Patent No.: US 9,437,910 B2
(45) **Date of Patent: *Sep. 6, 2016**

(54) MULTI-MODE FILTER

(75) Inventors: David Robert Hendry, Brisbane (AU); Steven John Cooper, Brisbane (AU); Peter Blakeborough Kenington, Chepstow (GB)

(73) Assignee: Mesaplexx Pty Ltd, Queensland (AU)

( * ) Notice: Subject to any disclaimer, the term of this patent is extended or adjusted under 35 U.S.C. 154(b) by 302 days.

This patent is subject to a terminal disclaimer.

(21) Appl. No.: 13/488,262

(22) Filed: Jun. 4, 2012

(65) Prior Publication Data

US 2013/0049894 A1 Feb. 28, 2013

Related U.S. Application Data

(60) Provisional application No. 61/531,277, filed on Sep. 6, 2011.

(30) Foreign Application Priority Data

Aug. 23, 2011 (AU) ..... 2044903389

(51) Int. Cl.
*H01P 1/20* (2006.01)
*H01P 7/10* (2006.01)
*H01P 1/208* (2006.01)

(52) U.S. Cl.
CPC ..... *H01P 1/2086* (2013.01); *H01P 1/2088* (2013.01); *H01P 7/105* (2013.01); *Y10T 29/49016* (2015.01)

(58) Field of Classification Search
CPC ..... H01P 7/105; H01P 1/20; H01P 1/2086; H01P 1/2088
USPC ..... 333/202, 219.1, 208
See application file for complete search history.

(56) References Cited

U.S. PATENT DOCUMENTS 2,890,421 A 6/1959 Currie
3,657,670 A 4/1972 Kitazume et al. ..... 333/73 W
(Continued)

FOREIGN PATENT DOCUMENTS

CA 1189154 A2 6/1985
CA 1194157 A1 9/1985
(Continued)

OTHER PUBLICATIONS

Dupont, "Properties Handbook",Dupont,p. 4.*
(Continued)

*Primary Examiner* — Robert Pascal
*Assistant Examiner* — Gerald Stevens
(74) *Attorney, Agent, or Firm* — Harrington & Smith

(57) ABSTRACT

A dielectric resonator body for a multi-mode cavity filter, the resonator body including: a piece of first dielectric material, with at least one substantially flat face for mounting on a substrate, the piece of first dielectric material having a shape such that it can support at least a first resonant mode and at least one spurious response; and a layer of conductive material at least partially coating the resonator body; wherein the piece of first dielectric material includes at least one region having a different dielectric constant to the first dielectric material, whereby the presence of the region of different dielectric constant alters the frequency separation of the resonant mode and the spurious response.

29 Claims, 16 Drawing Sheets

(56) References Cited

U.S. PATENT DOCUMENTS

| | | | | |
|---|---|---|---|---|
| 4,142,164 | A | 2/1979 | Nishikawa et al. | |
| 4,614,920 | A | 9/1986 | Tong | |
| 4,622,523 | A | 11/1986 | Tang | |
| 4,623,857 | A | 11/1986 | Nishikawa et al. | |
| 4,630,009 | A | 12/1986 | Tang | |
| 4,644,305 | A | 2/1987 | Tang et al. | |
| 4,675,630 | A | 6/1987 | Tang et al. | |
| 4,792,771 | A | 12/1988 | Siu | |
| 4,879,533 | A | 11/1989 | de Muro et al. | 333/206 |
| 4,963,844 | A * | 10/1990 | Konishi | H01P 1/207 333/202 |
| 5,023,866 | A * | 6/1991 | De Muro | 370/278 |
| 5,307,036 | A | 4/1994 | Turunen et al. | 333/202 |
| 5,325,077 | A | 6/1994 | Ishikawa et al. | 333/219.1 |
| 5,585,331 | A | 12/1996 | Mansour et al. | |
| 5,589,807 | A | 12/1996 | Tang | |
| 5,710,530 | A | 1/1998 | Wada et al. | |
| 5,731,751 | A | 3/1998 | Vangala | |
| 5,805,035 | A | 9/1998 | Accatino et al. | |
| 5,821,837 | A | 10/1998 | Accatino et al. | |
| 6,005,457 | A | 12/1999 | Wu | |
| 6,016,091 | A | 1/2000 | Hidaka et al. | 333/202 |
| 6,025,291 | A | 2/2000 | Murakawa | 501/136 |
| 6,066,996 | A | 5/2000 | Goertz et al. | |
| 6,072,378 | A | 6/2000 | Kurisu et al. | |
| 6,133,808 | A | 10/2000 | Arakawa | 333/134 |
| 6,160,463 | A | 12/2000 | Arakawa et al. | 333/202 |
| 6,278,344 | B1 | 8/2001 | Kurisu et al. | |
| 6,346,867 | B2 | 2/2002 | Arakawa et al. | 333/208 |
| 6,462,629 | B1 | 10/2002 | Blair et al. | |
| 6,549,094 | B2 | 4/2003 | Takagi et al. | 333/134 |
| 6,677,837 | B2 | 1/2004 | Kojima et al. | 333/208 |
| 6,762,658 | B1 | 7/2004 | Isomura et al. | 333/202 |
| 6,825,740 | B2 | 11/2004 | Kundu | 333/202 |
| 6,834,429 | B2 | 12/2004 | Blair et al. | |
| 6,853,271 | B2 | 2/2005 | Wilber et al. | |
| 6,897,741 | B2 | 5/2005 | Ando et al. | |
| 6,954,122 | B2 | 10/2005 | Wilber et al. | |
| 7,042,314 | B2 | 5/2006 | Wang et al. | 333/202 |
| 7,068,127 | B2 | 6/2006 | Wilber et al. | |
| 7,138,891 | B2 | 11/2006 | Andoh et al. | |
| 7,605,678 | B2 | 10/2009 | Ando et al. | |
| 7,755,456 | B2 | 7/2010 | Salehi | |
| 8,022,792 | B2 | 9/2011 | Howard | |
| 8,325,077 | B2 | 12/2012 | Gentric | 341/173 |
| 2001/0000429 | A1 | 4/2001 | Arakawa et al. | 333/208 |
| 2001/0024147 | A1* | 9/2001 | Arakawa et al. | 333/135 |
| 2002/0024410 | A1 | 2/2002 | Guglielmi et al. | 333/202 |
| 2002/0039058 | A1 | 4/2002 | Sano et al. | 333/202 |
| 2003/0006864 | A1 | 1/2003 | Hattori et al. | 333/202 |
| 2003/0090344 | A1* | 5/2003 | Wang et al. | 333/202 |
| 2003/0141948 | A1 | 7/2003 | Maekawa et al. | |
| 2003/0227360 | A1* | 12/2003 | Kirihara et al. | 333/239 |
| 2004/0041660 | A1 | 3/2004 | Kawahara et al. | |
| 2004/0056736 | A1 | 3/2004 | Enokihara et al. | 333/202 |
| 2005/0128031 | A1 | 6/2005 | Wilber et al. | 333/202 |
| 2005/0140474 | A1 | 6/2005 | Kim et al. | 333/219.1 |
| 2005/0253672 | A1* | 11/2005 | Enokihara et al. | 333/219.1 |
| 2006/0139127 | A1 | 6/2006 | Wada et al. | 333/202 |
| 2008/0018391 | A1 | 1/2008 | Bates | 327/557 |
| 2008/0061905 | A1 | 3/2008 | Ishikawa | |
| 2008/0211601 | A1 | 9/2008 | Bates | 333/186 |
| 2010/0231323 | A1 | 9/2010 | Vangala et al. | |
| 2011/0006856 | A1 | 1/2011 | Kim et al. | |
| 2011/0128097 | A1 | 6/2011 | Park et al. | |
| 2014/0077900 | A1 | 3/2014 | Rogozine et al. | 333/212 |

FOREIGN PATENT DOCUMENTS

| | | | |
|---|---|---|---|
| EP | 0883203 | A3 | 10/1999 |
| JP | H0216801 | | 1/1990 |
| JP | H-10284988 | | 1/1998 |
| JP | H-1079636 | | 3/1998 |
| JP | H-10209808 | | 8/1998 |
| JP | H-10224113 | | 8/1998 |
| JP | H-10294644 | | 11/1998 |
| JP | H-10322161 | | 12/1998 |
| JP | 2000295072 | A | 10/2000 |
| JP | 2001060804 | A | 3/2001 |
| JP | 2001060805 | A | 3/2001 |
| JP | 2001160/02 | A | 6/2001 |
| JP | 2002135003 | A | 5/2002 |
| JP | 2002151906 | A | 5/2002 |
| JP | 2002217663 | A | 8/2002 |
| JP | 2003037476 | A | 2/2003 |
| JP | 2003188617 | A | 7/2003 |
| JP | 2003234635 | A | 8/2003 |
| JP | 2004312287 | A | 11/2004 |
| JP | 2004312288 | A | 11/2004 |
| JP | 2005065040 | A | 3/2005 |
| JP | 2005167577 | A | 6/2005 |
| JP | 2005223/21 | A | 8/2005 |
| WO | WO-9301626 | A1 | 1/1993 |
| WO | WO-0077863 | A1 | 12/2000 |
| WO | WO-02078119 | A1 | 10/2002 |

OTHER PUBLICATIONS

Trak Ceramics, "Dielectric Materials",Trak Ceramics, p. 1.*

Dupont, "Properties Handbook", Dupont, Nov. 2003, p. 4.*

Trak Ceramics, "Dielectric Materials", Trak Ceramics, Jun. 1, 2000, p. 1.*

Awai, Ikuo, et al; Equivalent-Circuit Representation and Explanation of Attenuation Poles of a Dual-Mode Dielectric-Resonator Bandpass Filter; Transactions on Microwave Theory and Techniques; (Dec. 1998); pp. 2159-2163; vol. 46; No. 12; IEEE.

Awai, Ikuo, et al; Coupling of Dual Modes in a Dielectric Waveguide Resonator and its Application to Bandpass Filters; Proceedings of the 25th European Microwave Conference; (1995); pp. 533-537: Conf. 25; Yamaguchi University, Japan.

Weily, Andrew R, et al; Rotationally Symmetric FDTD for Fast Design and Wideband Spurious Performance Prediction of Dielectric Resonator Filters; Telecom Group, Faculty of Engineering, University of Technology; (1999); pp. 844-847.

Chaudhary, Raghvendra Kumar, et al.; Multi-Layer Multi-Permittivity Dielectric Resonator: A New Approach for Improved Spurious Free Window; Proceedings of the 40th European Microwave Conference; (Sep. 28-30, 2010); pp. 1194-1197; Paris, France.

Sano, Kazuhisa, et al.; Application of the Planar I/O Terminal to Dual Mode Dielectric Waveguide Filters; International Microwave Symposium Digest; (Jun. 11-16, 2000); pp. 1173-1176; Boston, MA.

Wang, Chi, et al; A Practical Triple-Mode Monoblock Bandpass Filter for Base Station Applications; MTT-S Digest; (2001); pp. 1783-1786.

Awai, Ikuo, et al; A Dual Mode Dielectric Waveguide Resonator and its Application to Bandpass Filters; IEICE Transactions on Electronics; (Aug. 1995); pp. 1018-1025; vol. E78-C; No. 8.

Bekheit, Maged, et al.; Modeling and Optimization of Compact Microwave Bandpass Filters; IEEE Transactions of Microwave Theory and Techniques; (Feb. 2008); pp. 420-430; vol. 56; No. 2.

* cited by examiner

MULTI-MODE FILTER

CROSS REFERENCE TO RELATED APPLICATIONS

The present application is related to and claims the benefit of Australian Provisional Patent Application No. 2011903389, filed Aug. 23, 2011 and U.S. Provisional Patent Application No. 61/531,277, filed Sep. 6, 2011, both of whose disclosures are hereby incorporated by reference in their entirety into the present disclosure.

BACKGROUND OF THE INVENTION

The present invention relates to a multi-mode filter, and in particular to a multi-mode filter including a resonator body, for use, for example in frequency division duplexers for telecommunication applications.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

All physical filters essentially consist of a number of energy storing resonant structures, with paths for energy to flow between the various resonators and between the resonators and the input/output ports. The physical implementation of the resonators and the manner of their interconnections will vary from type to type, but the same basic concept applies to all. Such a filter can be described mathematically in terms of a network of resonators coupled together, although the mathematical topography does not have to match the topography of the real filter.

Conventional single-mode filters formed from dielectric resonators are known. Dielectric resonators have high-Q (low loss) characteristics which enable highly selective filters having a reduced size compared to cavity filters. These single-mode filters tend to be built as a cascade of separated physical dielectric resonators, with various couplings between them and to the ports. These resonators are easily identified as distinct physical objects, and the couplings tend also to be easily identified.

Single-mode filters of this type may include a network of discrete resonators formed from ceramic materials in a "puck" shape, where each resonator has a single dominant resonance frequency, or mode. These resonators are coupled together by providing openings between cavities in which the resonators are located. Typically, the resonators provide transmission poles or "zeros", which can be tuned at particular frequencies to provide a desired filter response. A number of resonators will usually be required to achieve suitable filtering characteristics for commercial applications, resulting in filtering equipment of a relatively large size.

One example application of filters formed from dielectric resonators is in frequency division duplexers for microwave telecommunication applications. Duplexers have traditionally been provided at base stations at the bottom of antenna supporting towers, although a current trend for microwave telecommunication system design is to locate filtering and signal processing equipment at the top of the tower to thereby minimise cabling lengths and thus reduce signal losses. However, the size of single mode filters as described above can make these undesirable for implementation at the top of antenna towers.

Multimode filters implement several resonators in a single physical body, such that reductions in filter size can be obtained. As an example, a silvered dielectric body can resonate in many different modes. Each of these modes can act as one of the resonators in a filter. In order to provide a practical multimode filter it is necessary to couple the energy between the modes within the body, in contrast with the coupling between discrete objects in single mode filters, which is easier to control in practice.

The usual manner in which these multimode filters are implemented is to selectively couple the energy from an input port to a first one of the modes. The energy stored in the first mode is then coupled to different modes within the resonator by introducing specific defects into the shape of the body. In this manner, a multimode filter can be implemented as an effective cascade of resonators, in a similar way to conventional single mode filter implementations. Again, this technique results in transmission poles which can be tuned to provide a desired filter response.

An example of such an approach is described in U.S. Pat. No. 6,853,271, which is directed towards a triple-mode mono-body filter. Energy is coupled into a first mode of a dielectric-filled mono-body resonator, using a suitably configured input probe provided in a hole formed on a face of the resonator. The coupling between this first mode and two other modes of the resonator is accomplished by selectively providing corner cuts or slots on the resonator body.

This technique allows for substantial reductions in filter size because a triple-mode filter of this type represents the equivalent of a single-mode filter composed of three discrete single mode resonators. However, the approach used to couple energy into and out of the resonator, and between the modes within the resonator to provide the effective resonator cascade, requires the body to be of complicated shape, increasing manufacturing costs.

Two or more triple-mode filters may still need to be cascaded together to provide a filter assembly with suitable filtering characteristics. As described in U.S. Pat. Nos. 6,853,271 and 7,042,314 this may be achieved using a waveguide or aperture for providing coupling between two resonator mono-bodies. Another approach includes using a single-mode mechanical resonator coupled between two dielectric mono-bodies to form a hybrid filter assembly as described in U.S. Pat. No. 6,954,122. In any case the physical complexity and hence manufacturing costs are even further increased.

SUMMARY

According to a first aspect of the present invention there is provided a dielectric resonator body for a multi-mode cavity filter, the resonator body including:

- a piece of first dielectric material, with at least one substantially flat face for mounting on a substrate, the piece of first dielectric material having a shape such that it can support at least a first resonant mode and at least one spurious response; and
- a layer of conductive material at least partially coating the resonator body;
- wherein the piece of first dielectric material includes at least one region having a different dielectric constant to the first dielectric material, whereby the presence of the region of different dielectric constant alters the frequency separation of the resonant mode and the spurious response.

The region of different dielectric constant may have a lower dielectric constant relative to the first dielectric material, whereby the frequency separation of the first resonant mode and the spurious response is increased.

The shape of the first dielectric material may include a plurality of surfaces and supports a plurality of resonant modes, the resonator body including at least one of said regions of different dielectric constant on at least one of the surfaces. The region of different dielectric constant may be located at an area of the respective surface at which the field distribution of the spurious response is more concentrated than that of the first resonant mode. The resonator body may be cuboid and the region of different dielectric constant located at the centre of the respective surface.

The region of different dielectric constant may comprise a piece of second dielectric material secured adjacent to the piece of first dielectric material. The piece of second dielectric material may protrude from the surface of the first piece of dielectric material. Alternatively, the piece of second dielectric material may be located within a recess formed in the first piece of dielectric material. Alternatively, the piece of second dielectric material may encapsulate the first piece of dielectric material.

The resonator body may further comprise at least one piece of third dielectric material secured adjacent to the piece of second dielectric material, the second and third dielectric materials having different dielectric constants.

The piece of second dielectric material may be shaped as one of the following: a cylinder, a cuboid, a polyhedron, a portion of a sphere and a prism.

The piece of second dielectric material may be bonded to the first dielectric material. Alternatively, the piece of second dielectric material may be mechanically secured adjacent to the first dielectric material.

Alternatively, the region of different dielectric constant may comprise a gas filled space covered by said conductive material.

The gas filled space may be defined by at least one recess formed in the first dielectric material. Alternatively, the gas filled space may be defined by at least one hollow shaped portion of said conductive material affixed to the surface of the first dielectric material.

According to a second aspect of the present invention there is provided a method of manufacturing a dielectric resonator body for a multi-mode cavity filter, the method comprising:

providing a piece of first dielectric material, with at least one substantially flat face for mounting on a substrate, the piece of first dielectric material having a shape such that it can support at least a first resonant mode and at least one spurious response; and providing a layer of conductive material at least partially coating the resonator body;

wherein the piece of first dielectric material includes at least one region having a different dielectric constant to the first dielectric material, whereby the presence of the region of different dielectric alters the frequency separation of the resonant mode and the spurious response.

The region of different dielectric constant may have a lower dielectric constant relative to the first dielectric material, whereby the frequency separation of the first resonant mode and the spurious response is increased.

The region of different dielectric constant may comprise a piece of second dielectric material secured adjacent to the piece of first dielectric material. The second dielectric material may be bonded to the surface of the first dielectric material.

Alternatively, the piece of second dielectric material may be mechanically secured adjacent to the first dielectric material.

Alternatively, one or more recesses may be formed in the first dielectric material and the second dielectric material is located within the recesses.

The piece of second dielectric material may encapsulate the first piece of dielectric material.

The step of providing the layer of conductive material may include providing a layer of the conductive material coating the first dielectric material; subsequently removing portions of the conductive layer at one or more locations; and adhering respective pieces of the second dielectric material to the first dielectric material at said locations.

The step of providing the layer of conductive material may alternatively include providing a layer of conductive material in a predefined pattern on the first dielectric material, the pattern including selected regions where no conductive material is provided; and subsequently securing respective pieces of the second dielectric material adjacent to the first dielectric material at said selected regions.

The respective pieces of the second dielectric material may be partially coated in the conductive material prior to being secured adjacent to the first dielectric material.

The region of different dielectric constant may be formed by creating one or more recesses in the first dielectric material prior to providing said conductive layer. The recess may be covered with a planar conductive element.

According to an aspect of the present invention, there is provided a multi-mode cavity filter, comprising: at least one dielectric resonator body incorporating a piece of dielectric material, the piece of dielectric material having a shape such that it can support at least a first resonant mode and at least a second substantially degenerate resonant mode; a layer of conductive material in contact with and covering the dielectric resonator body; and a coupling structure comprising at least one electrically conductive coupling path for at least one of inputting signals to the dielectric resonator body and outputting signals from the dielectric resonator body, the at least one electrically conductive coupling path being arranged for at least one of directly coupling signals to the first resonant mode and the second substantially degenerate resonant mode in parallel, and directly coupling signals from the first resonant mode and the second substantially degenerate resonant mode in parallel.

The at least one electrically conductive coupling path may, for example, comprise at least one of an input coupling path and an output coupling path for respectively coupling signals to and from the dielectric resonator body.

The at least one coupling path may, for example, run substantially parallel to a surface of the dielectric resonator body. The at least one coupling path may, for example, lie adjacent the surface of the dielectric resonator body.

The at least one coupling path may, for example, comprise a first portion primarily for coupling to the first mode and a second portion primarily for coupling to the second mode. The first portion of the at least one coupling path may, for example, be oriented such that at least one of the magnetic field and the electric field generated by said first portion is substantially aligned with the respective magnetic field or electric field of said first mode. The second portion of the at least one coupling path may, for example, be oriented such that at least one of the magnetic field and the electric field generated by said second portion is substantially aligned with the respective magnetic field or electric field of said second mode. The first portion and second portion may, for example, be any of the following: a straight or curved elongate track, and a patch. The first portion may, for example, comprise a first straight elongate track and the second portion may, for example, comprise a second straight elongate track arranged substantially orthogonally to the first straight elongate track.

The at least one coupling path may, for example, comprise a portion for coupling simultaneously to both the first mode and the second mode. The portion may, for example, comprise an elongate track oriented at an angle such that at least one of the magnetic field and the electric field generated by said portion has a first Cartesian component aligned with the respective magnetic field or electric field of said first mode, and a second Cartesian component aligned with the respective magnetic field or electric field of said second mode.

The coupling structure may, for example, be formed in the layer of conductive material.

The multi-mode cavity filter may, for example, further comprise a substrate on which the dielectric resonator body is mounted. The coupling structure may, for example, be formed on the substrate. The substrate may, for example, comprise at least one of an input electrically coupled to said coupling structure for providing signals to the coupling structure and an output electrically coupled to said coupling structure for receiving filtered signals from the coupling structure. The substrate may, for example, comprise a printed circuit board.

The piece of dielectric material may, for example, comprise a substantially planar surface for mounting to the substrate. The coupling structure may, for example, be provided on or adjacent to said substantially planar surface.

The coupling structure may, for example, be provided on a substantially planar surface of said piece of dielectric material.

According to another aspect of the present invention there is provided a dielectric resonator body for a multi-mode cavity filter, the resonator including:

- a piece of dielectric material, with at least one substantially flat face for mounting on a substrate layer, the piece of dielectric material having a shape such that it can support at least a first resonant mode and at least one substantially degenerate resonant mode;
- wherein the shape of the piece of dielectric material is such that the first resonant mode and the at least one substantially degenerate resonant mode are capable of being simultaneously independently excited, and
- wherein the piece of dielectric material is at least partially covered with a layer of conductive material.

The dielectric material may have at least two axes and the each resonant mode is at least partially in the direction of a respective axis. Preferably, the dielectric body has three axes and supports three resonant modes that are substantially in the direction of said axes.

The piece of dielectric material may have at least one axis of symmetry. The axis of symmetry may be in respect of rotational or reflection symmetry.

The piece of dielectric material may have a shape arranged such that, in conjunction with its associated coupling structures, each resonant mode has a different centre frequency to the remaining resonant modes. Additionally, the piece of dielectric material may have a shape arranged such that each resonant mode has a centre frequency adjacent to another one of the resonant modes. Furthermore, the piece of dielectric material may have a respective major axis corresponding to each resonant mode and is asymmetric about at least one of the major axes.

The piece of dielectric material may have one or more further surfaces in addition to the flat face, each further surface being substantially even.

The piece of dielectric material may comprise one of a polyhedron, cuboid, cylinder, a hemisphere (or other portion of a sphere), prism, pyramid or any form of extruded shape.

The piece of dielectric material may include a ceramic material.

According to a further aspect of the present invention there is provided a multi-mode cavity filter including:

- a dielectric resonator body for a multi-mode cavity filter, the resonator including:
  - a piece of dielectric material, with at least one substantially flat face for mounting on a substrate layer, the piece of dielectric material having a shape such that it can support at least a first resonant mode and at least one substantially degenerate resonant mode;
  - wherein the shape of the piece of dielectric material is such that the first resonant mode and the at least one substantially degenerate resonant mode are capable of being independently excited simultaneously, and
  - wherein the piece of dielectric material is at least partially covered with a layer of conductive material; and
- a coupling structure comprising at least one electrically conductive coupling path for inputting signals to and/or outputting signals from the dielectric resonator body, the at least one electrically conductive coupling path being coupled to the substantially flat face.

The dielectric material may have at least two axes and the each resonant mode is at least partially in the direction of a respective axis.

The piece of dielectric material may have a shape arranged such that, in conjunction with its associated coupling structures, each resonant mode has a different centre frequency to the remaining resonant modes. Additionally, the piece of dielectric material may have a shape arranged such that each resonant mode has a centre frequency adjacent to another one of the resonant modes. Also, the piece of dielectric material may have a respective major axis corresponding to each resonant mode and is asymmetric about at least one of the major axes.

The piece of dielectric material may have one or more further surfaces in addition to the flat face, each further surface being substantially even.

The piece of dielectric material may comprise one of a polyhedron, a cuboid, a cylinder, a hemisphere (or other portion of a sphere), prism, pyramid or any form of extruded shape.

According to various embodiments of another aspect of the present invention, there is provided a multi-mode cavity filter, comprising: at least one dielectric resonator body incorporating a piece of dielectric material, the piece of dielectric material having a shape such that it can support at least a first resonant mode and at least a second substantially degenerate resonant mode; and a coupling structure comprising a patterned conductive layer for at least one of coupling signals to the piece of dielectric material and coupling signals from the piece of dielectric material.

The patterned conductive layer may, for example, be substantially in contact with the dielectric resonator body.

The patterned conductive layer may, for example, comprise at least one of an input coupling path and an output coupling path for respectively coupling signals to and from the dielectric resonator body. The input coupling path and/or the output coupling path may, for example, be for directly coupling signals to or from the first mode and the second mode in parallel.

The input coupling path and/or the output coupling path may, for example, comprise a first portion primarily for coupling to the first mode and a second portion primarily for coupling to the second mode. The first portion of the input coupling path and/or the output coupling path may, for example, be oriented such that at least one of the magnetic field and the electric field generated by said first portion is substantially aligned with the respective magnetic field or electric field of said first mode, and the second portion of the input coupling path and/or the output coupling path may be oriented such that at least one of the magnetic field and the electric field generated by said second portion is substantially aligned with the respective magnetic field or electric field of said second mode.

The first portion and second portion may, for example, be any of the following: a straight or curved elongate track, and a patch. The first portion may comprise a first straight elongate track and the second portion may comprise a second straight elongate track arranged substantially orthogonally to the first straight elongate track.

The input coupling path and/or the output coupling path may, for example, comprise a portion for coupling simultaneously to both the first mode and the second mode. The portion may, for example, comprise an elongate track oriented at an angle such that at least one of the magnetic field and the electric field generated by said portion has a first Cartesian component aligned with the respective magnetic field or electric field of said first mode, and a second Cartesian component aligned with the respective magnetic field or electric field of said second mode.

The patterned conductive layer may, for example, form part of a coating covering the piece of dielectric material.

The multi-mode cavity filter may further comprise a substrate on which the dielectric resonator body is mounted. The patterned conductive layer may be formed on the substrate. The substrate may, for example, comprise at least one of an input electrically coupled to said coupling structure for providing signals to the coupling structure and an output electrically coupled to said coupling structure for receiving filtered signals from the coupling structure.

The substrate may, for example, comprise a printed circuit board.

The piece of dielectric material may comprise a substantially planar surface for mounting to the substrate. The patterned conductive layer may, for example, be provided on said substantially planar surface.

The patterned conductive coating may, for example, be provided on a substantially planar surface of said piece of dielectric material. The patterned conductive coating may comprise an input coupling path and an output coupling path for respectively coupling signals to and from the dielectric resonator body.

In a further aspect of the present invention, there is provided a method of manufacturing a multi-mode cavity filter, comprising: providing at least one dielectric resonator body incorporating a piece of dielectric material, the piece of dielectric material having a shape such that it can support at least a first resonant mode and at least a second substantially degenerate resonant mode; and forming a patterned conductive layer comprising a coupling structure for at least one of coupling signals to the dielectric resonator body and coupling signals from the dielectric resonator body.

The step of forming a patterned conductive layer may, for example, comprise: coating the piece of dielectric material with conductive material; and etching said coating to form said coupling structure.

The step of forming a patterned conductive layer may, for example, comprise: printing, depositing or painting said piece of dielectric material with conductive material to form said coupling structure.

The step of forming a patterned conductive layer may, for example, comprise: forming a patterned conductive layer in a substrate on which the piece of dielectric material is mounted.

According to some embodiments, the invention provides a multi-mode cavity filter, comprising a resonator body of dielectric material capable of supporting at least two degenerate electromagnetic wave propagation modes and having a face, and a conductive pattern on at least part of the face for coupling a radio frequency signal between the pattern and the resonator body. The body might have more than one face. Using a conductive pattern on the body to couple radio frequency signals to and/or from the body can provide for a relatively simple construction in that the body does not need to be worked to create ports or the like for accommodating conductive connections. Moreover, such a pattern can, in some embodiments, be used to provide both an input for launching a radio frequency signal into the resonator body and an output for receiving a radio frequency signal from the resonator body, meaning that the cavity filter can have a relatively compact construction.

The pattern may, for example, be a layer. The pattern may, for example, be a coating on the face. The pattern may, for example, form part of a conductive covering over the resonator body.

The pattern may, for example, include a first part and a second part and the first and second parts are electrically isolated from one another. For example, the first and second parts may be, respectively, an input for launching the signal into the resonator body and an output for recovering the signal from the resonator body.

The pattern may, for example, include a first part and a second part, where the first part is an input for launching the signal into the resonator body and the second part is an output for recovering the signal from the resonator body.

The part of the face on which the pattern resides may, for example, be flat.

The pattern may, for example, be provided on a substrate. The substrate may, for example, be a printed circuit board.

In some embodiments, the pattern includes an elongate path for launching the signal into the resonator body, the path having an open-circuited end. Such a path may, for example, include first and second parts, each part being for coupling the signal to a standing wave in a respective one of two non-interfering electromagnetic wave modes within the resonator body. Such non-interfering electromagnetic waves are sometimes referred to as 'orthogonal', however this does not necessarily imply that they have a 90 degree spatial relationship one with another. The first part may, for example, be elongate and the second part may, for example, be a patch, or the first and second parts may, for example, both be elongate and extend in different, possibly orthogonal, directions. At least one of the parts may, for example, be straight.

In some embodiments, the pattern includes another elongate path such that there are first and second elongate paths, wherein the first and second paths serve respectively as an input for launching the signal into the resonator body and an output for coupling the signal out of the resonator body.

According to some embodiments, the invention provides a method of manufacturing a multi-mode cavity filter, the method comprising providing a resonator body of dielectric material capable of supporting at least two degenerate electromagnetic propagation modes and having a face, and providing a conductive pattern on at least part of the face for coupling a radio frequency signal between the pattern and the resonator body.

Providing the pattern may, for example, involve coating at least part of the face with conductive material and removing part of the coating to form the pattern.

Providing the pattern may, for example, involve at least one of painting, depositing and printing the pattern on at least part of the face.

Providing the pattern may, for example, involve providing the pattern on a substrate and offering the substrate to the face.

According to an aspect of the present invention, there is provided a multi-mode cavity filter, comprising: a dielectric resonator; a coupling structure for coupling input signals to the dielectric resonator and/or for extracting filtered output signals from the dielectric resonator; a covering of conductive material around the dielectric resonator and comprising an aperture; and a printed circuit board structure having at least one ground plane layer arranged over said aperture and electrically coupled to the covering of conductive material.

The dielectric resonator may, for example, incorporate a piece of dielectric material, the piece of dielectric material having a shape such that it can support at least a first resonant mode and at least a second substantially degenerate resonant mode.

The coupling structure may, for example, be arranged for at least one of coupling input signals to the dielectric resonator through the aperture and extracting filtered output signals from the dielectric resonator through the aperture.

The coupling structure may, for example, comprise a first electrical connection on the surface of the dielectric resonator and a second electrical connection in a layer of the printed circuit board structure. The second electrical connection may, for example, be arranged in an outermost layer of the printed circuit board structure. The second electrical connection may, for example, be coupled to an inner signal layer of the printed circuit board structure.

The coupling structure may, for example, comprise at least one conductive track arranged on the surface of the dielectric resonator. The at least one conductive track may, for example, comprise a first portion for at least one of coupling signals to and extracting signals from a first resonant mode of the dielectric resonator and a second portion for at least one of coupling signals to and extracting signals from a second resonant mode of the dielectric resonator.

The printed circuit board structure may, for example, comprise a first ground plane layer electrically connected to the covering of conductive material and at least a second ground plane layer electrically coupled to the first ground plane layer. The first and second ground plane layers may, for example, be electrically coupled such that energy leakage from the dielectric resonator is reflected back into the dielectric resonator. The first ground plane layer may, for example, be continuously electrically coupled to the covering of conductive material around the aperture. The coupling structure may, for example, be electrically connected to an inner signal layer of the printed circuit board structure by a connection which passes through said first and second ground plane layers.

The printed circuit board structure may, for example, comprise a first printed circuit board and a second printed circuit board electrically coupled to each other.

The dielectric resonator may, for example, comprise a piece of dielectric material having a flat surface, and wherein the aperture is arranged on the flat surface.

BRIEF DESCRIPTION OF THE DRAWINGS

An example of the present invention will now be described with reference to the accompanying drawings, in which.

DETAILED DESCRIPTION OF THE PREFERRED EMBODIMENTS

Figure 1A:
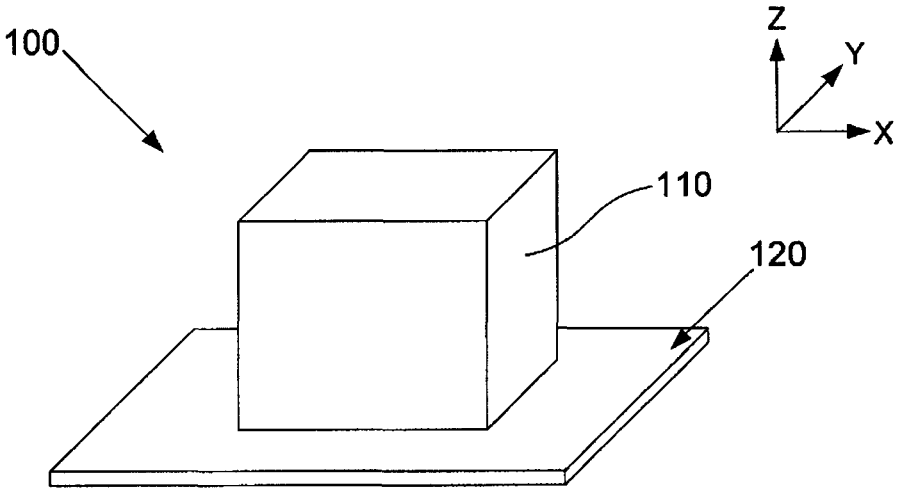
FIG. 1A is a schematic perspective view of an example of a multi-mode filter.
Figure 1B:
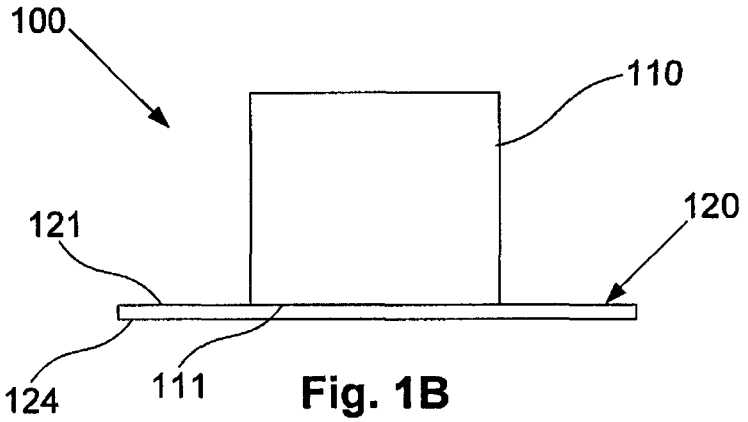
FIG. 1B is a schematic side view of the multi-mode filter of FIG. 1A.
Figure 1C:
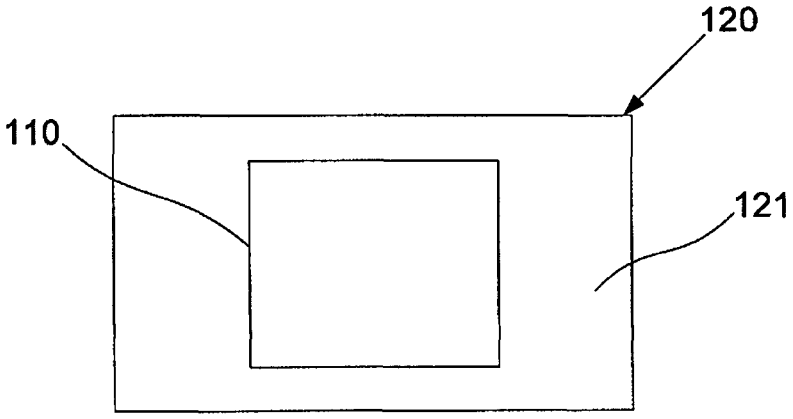
FIG. 1C is a schematic plan view of the multi-mode filter of FIG. 1A.

An example of a multi-mode filter will now be described with reference to FIGS. 1A to 1E.

In this example, the filter 100 includes a resonator body 110, and a coupling structure 130. The coupling structure 130 at least one conductive coupling path 131, 132, which includes an electrically conductive path extending adjacent at least part of a surface 111 of the resonator body 110, so that the coupling structure 130 provides coupling to a plurality of the resonance modes of the resonator body.

In use, a signal can be supplied to or received from the at least one conductive coupling path 131, 132. In a suitable configuration, this allows a signal to be filtered to be supplied to the resonator body 110 for filtering, or can allow a filtered signal to be obtained from the resonator body, as will be described in more detail below.

The use of electrically conductive resonator paths 131, 132 extending adjacent to the surface 111 allows the signal to be coupled to a plurality of resonance modes of the resonator body 110. This allows a more simplified configuration of resonator body 110 and coupling structures 130 to be used as compared to traditional arrangements. For example, this avoids the need to have a resonator body including cut-outs or other complicated shapes, as well as avoiding the need for coupling structures that extend into the resonator body. This, in turn, makes the filter cheaper and simpler to manufacture, and can provide enhanced filtering characteristics. In addition, the filter is small in size, typically of the order of 6000 $mm^3$ per resonator body, making the filter apparatus suitable for use at the top of antenna towers.

A number of further features will now be described.

In the above example, the coupling structure 130 includes two conductive coupling paths 131, 132, coupled to an input 141, an output 142, thereby allowing the conductive coupling paths to act as input and output paths respectively. In this instance, a signal supplied via the input 141 couples to the resonance modes of the resonator body 110, so that a filtered signal is obtained via the output 142. However, the use of two conductive coupling paths is for the purpose of example only, and one or more conductive coupling paths maybe used depending on the preferred implementation.

For example, a single conductive coupling path 131, 132 may be used if a signal is otherwise coupled to the resonator body 110. This can be achieved if the resonator body 110 is positioned in contact with, and hence is coupled to, another resonator body, thereby allowing signals to be received from or supplied to the other resonator body. Coupling structures may also include more conductive coupling paths, for example if multiple inputs and/or outputs are to be provided, although alternatively multiple inputs and/or outputs may be coupled to a single conductive coupling path, thereby allowing multiple inputs and/or outputs to be accommodated.

Alternatively, multiple coupling structures 130 may be provided, with each coupling structure 130 having one or more conductive coupling paths. In this instance, different coupling structures can be provided on different surfaces of the resonator body. A further alternative is for a coupling structure to extend over multiple surfaces of the resonator body, with different conductive coupling paths being provided on different surfaces, or with conductive coupling paths extending over multiple surfaces. Such arrangements can be used to allow a particular configuration of input and output to be accommodated, for example to meet physical constraints associated with other equipment, or to allow alternative coupling arrangements to be provided. In use, a configuration of the input and output resonator paths 131, 132, along with the configuration of the resonator body 110 controls a degree of coupling with each of the plurality of resonance modes and hence the properties of the filter, such as the frequency response.

The degree of coupling depends on a number of factors, such as a conductive coupling path width, a path length, a path shape, a path direction relative to the resonance modes of the resonator body, a size of the resonator body, a shape of the resonator body and electrical properties of the resonator body. It will therefore be appreciated that the example coupling structure and cube configuration of the resonator body is for the purpose of example only, and is not intended to be limiting.

Typically the resonator body 110 includes, and more typically is manufactured from a solid body of a dielectric material having suitable dielectric properties. In one example, the resonator body is a ceramic material, although this is not essential and alternative materials can be used. Additionally, the body can be a multilayered body including, for example, layers of materials having different dielectric properties. In one example, the body can include a core of a dielectric material, and one or more outer layers of different dielectric materials.

The resonator body 110 usually includes an external coating of conductive material, such as silver, although other materials could be used such as gold, copper, or the like. The conductive material may be applied to one or more surfaces of the body. A region of the surface adjacent the coupling structure may be uncoated to allow coupling of signals to the resonator body.

The resonator body can be any shape, but generally defines at least two orthogonal axes, with the resonator paths extending at least partially in the direction of each axis, to thereby provide coupling to multiple separate resonance modes.

Figure 2A:
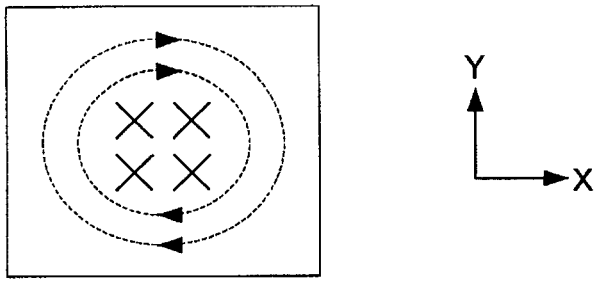
FIGS. 2A to 2C are schematic diagrams of examples the resonance modes of the resonator body of FIG. 1A.
Figure 2B:
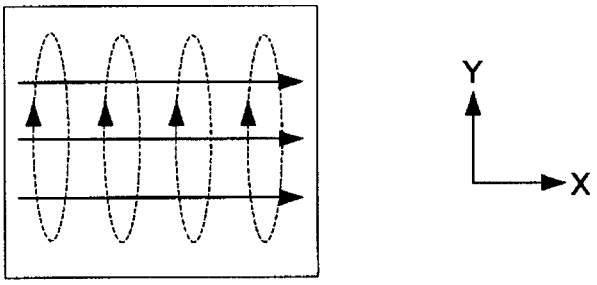
Figure 2C:
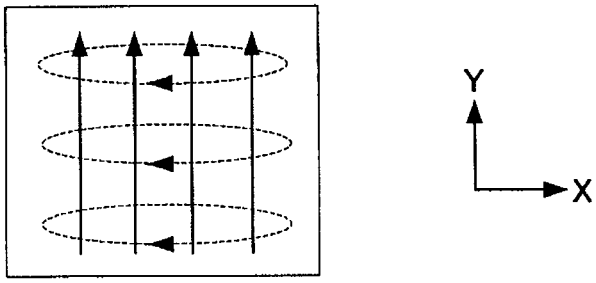

In the current example, the resonator body 110 is a cuboid body, and therefore defines three orthogonal axes substantially aligned with surfaces of the resonator body, as shown by the axes X, Y, Z. As a result, the resonator body 110 has three dominant resonance modes that are substantially orthogonal and substantially aligned with the three orthogonal axes. Examples of the different resonance modes are shown in FIGS. 2A to 2C, which show magnetic and electrical fields in dotted and solid lines respectively, with the resonance modes being generally referred to as TM110, TE011 and TE101 modes, respectively.

In this example, each resonator path 131, 132 includes a first path 131.1, 132.1 extending in a direction parallel to a first axis of the resonator body, and a second path 131.2, 132.2, extending in a direction parallel to a second axis orthogonal to the first axis. Each resonator path 131, 132 also includes an electrically conductive resonator patch 131.3, 132.3.

Thus, with the surface 111 provided on an X-Y plane, each resonator includes first and second paths 131.1, 131.2, 132.1, 132.2, extending in a plane parallel to the X-Y plane and in directions parallel to the X and Y axes respectively. This allows the first and second paths 131.1, 131.2, 132.1, 132.2 to couple to first and second resonance modes of the resonator body 110. The conductive coupling path patch 131.1, 131.2, defines an area extending in the X-Y plane and is for coupling to at least a third mode of the resonator body, as will be described in more detail below.

Figure 10A:
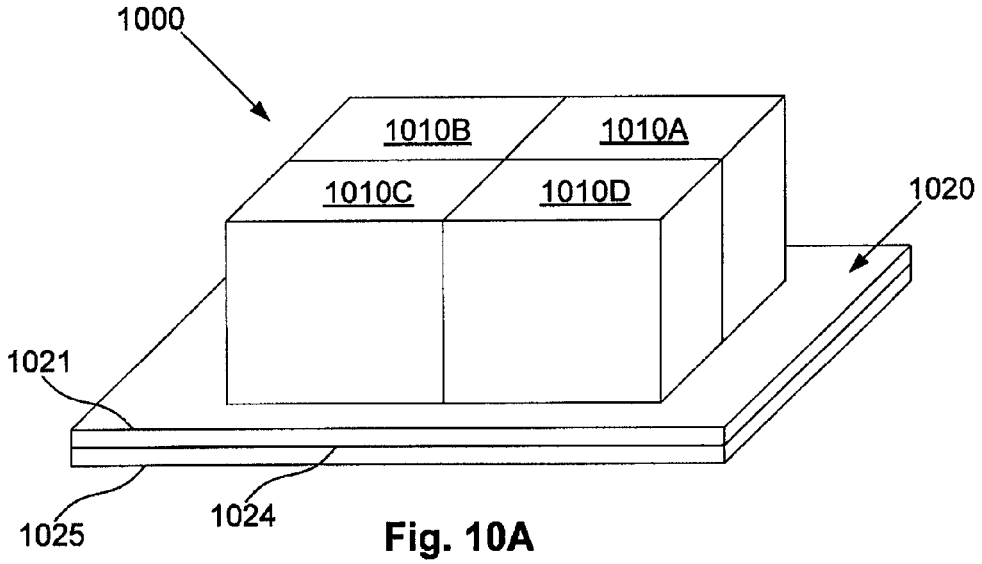
FIG. 10A is a schematic perspective view of an example of a multi-mode filter using multiple resonator bodies to provide filtering for transmit and receive channels.

Cuboid structures are particularly advantageous as they can be easily and cheaply manufactured, and can also be easily fitted together, for example by arranging multiple resonator bodies in contact, as will be described below with reference to FIG. 10A. Cuboid structures typically have clearly defined resonance modes, making configuration of the coupling structure more straightforward. Additionally, the use of a cuboid structure provides a planar surface 111 so that the conductive coupling path paths can be arranged in a plane parallel to the planar surface 111, with the conductive coupling path paths optionally being in contact with the resonator body 110. This can help maximise coupling between the resonators and resonator body 110, as well as allowing the coupling structure 130 to be more easily manufactured.

For example, the resonators may be provided on a substrate 120. In this instance, the provision of a planar surface 111 allows the substrate 120 to be a planar substrate, such as a printed circuit board (PCB) or the like, allowing the conductive coupling path paths 131, 132 to be provided as conductive paths on the PCB. However, alternative arrangements can be used, such as coating the resonant structures onto the resonator body directly.

Figure 1D:
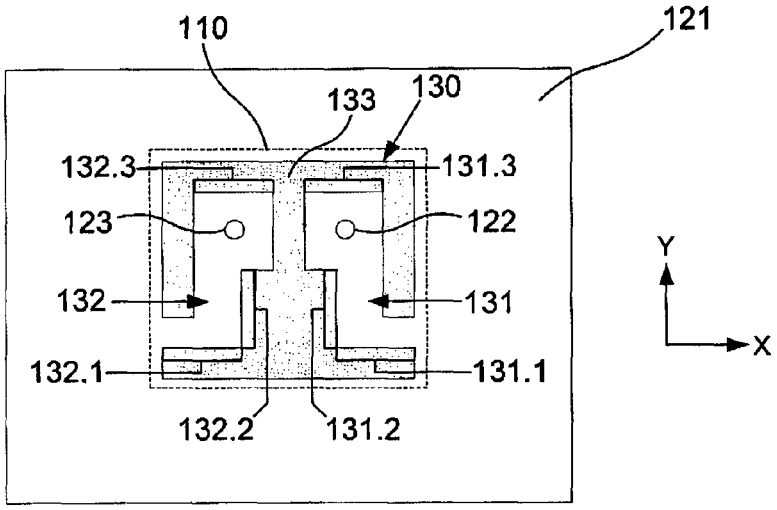
FIG. 1D is a schematic plan view of an example of the substrate of FIG. 1A including a coupling structure.
Figure 1E:
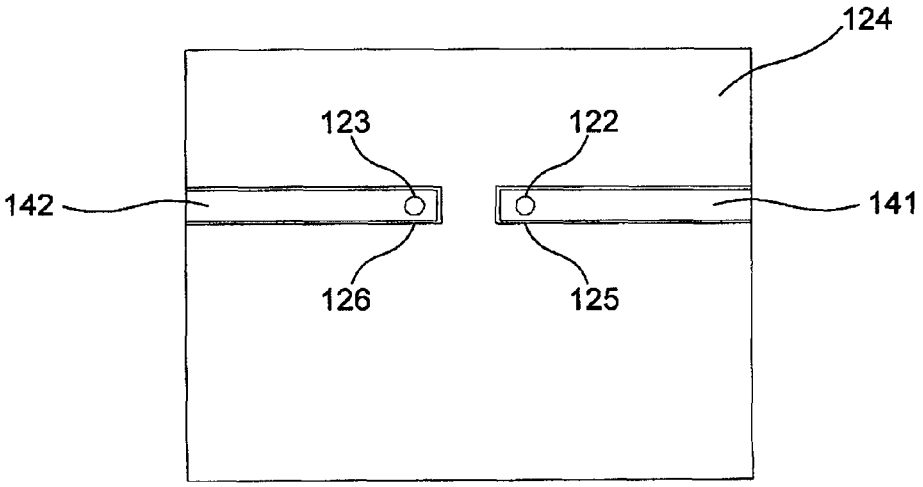
FIG. 1E is a schematic underside view of an example of the substrate of FIG. 1A including inputs and outputs.

In the current example, the substrate 120 includes a ground plane 121, 124 on each side, as shown in FIGS. 1D and 1E respectively. In this example, the conductive coupling path paths 131, 132 are defined by a cut-out 133 in the ground plane 121, so that the conductive coupling path paths 131, 132 are connected to the ground plane 121 at one end, although this is not essential and alternatively other arrangements may be used. For example, the conductive coupling paths do not need to be coupled to a ground plane, and alternatively open ended conductive coupling paths could be used. A further alternative is that a ground plane may not be provided, in which case the conductive coupling path paths 131, 132 could be formed from metal tracks applied to the substrate 120. In this instance, the conductive coupling paths 131, 132 can still be electrically coupled to ground, for example via vias or other connections provided on the substrate.

The input and output are provided in the form of conductive paths 141, 142 provided on an underside of the substrate 120, and these are typically defined by cut-outs 125, 126 in the ground plane 124. The input and output may in turn be coupled to additional connections depending on the intended application. For example, the input and output paths 141, 142 could be connected to edge-mount SMA coaxial connectors, direct coaxial cable connections, surface mount coaxial connections, chassis mounted coaxial connectors, or solder pads to allow the filter 100 to be directly soldered to another PCB, with the method chosen depending on the intended application. Alternatively the filter could be integrated into the PCB of other components of a communications system.

In the above example, the input and output paths 141, 142 are provided on an underside of the substrate. However, in this instance, the input and output paths 141, 142 are not enclosed by a ground plane. Accordingly, in an alternative example, a dual layered PCB can be used, with the input and output paths embedded as transmission lines inside the PCB, with the top and underside surfaces providing a continuous ground plane, as will be described in more detail below, with respect to the example of FIGS. 8A to 8E. This has the virtue of providing full shielding of the inner parts of the filter, and also allows the filter to be mounted to a conducting or non-conducting surface, as convenient.

The input and output paths 141, 142 can be coupled to the conductive coupling paths 131, 132 using any suitable technique, such as capacitive or inductive coupling, although in this example, this is achieved using respective electrical connections 122, 123, such as connecting vias, extending through the substrate 120. In this example, the input and output paths 141, 142 are electrically coupled to first ends of the conductive coupling path paths, with second ends of the conductive coupling path paths being electrically connected to ground.

In use, resonance modes of the resonator body provide respective energy paths between the input and output. Furthermore, the input conductive coupling path and the output conductive coupling path can be configured to allow coupling therebetween to provide an energy path separate to energy paths provided by the resonance modes of the resonator body. This can provide four parallel energy paths between the input and the output. These energy paths can be arranged to introduce at least one transmission zero to the frequency response of the filter, as will be described in more detail below. In this regard, the term "zero" refers to a transmission minimum in the frequency response of the filter, meaning transmission of signals at that frequency will be minimal, as will be understood by persons skilled in the art.

Figure 3A:
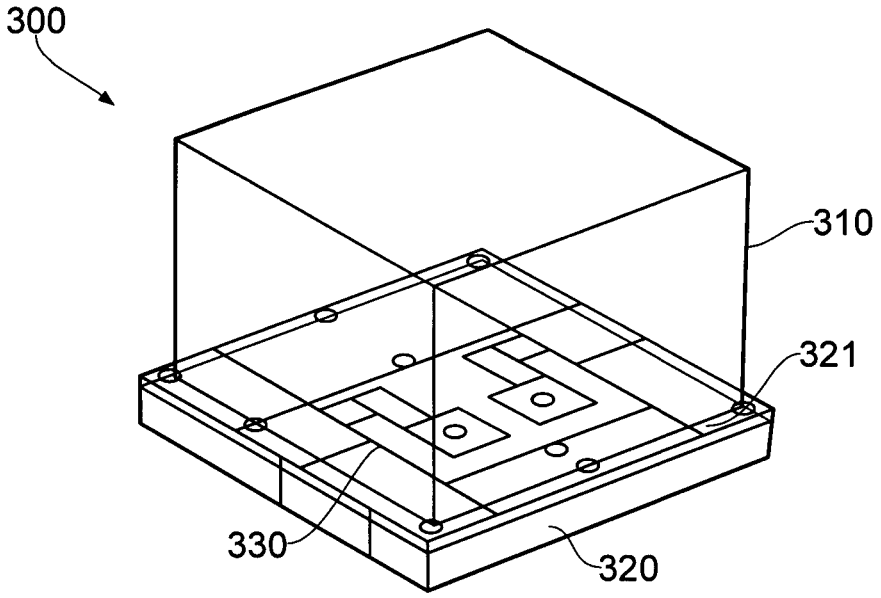
FIG. 3A is a schematic perspective view of an example of a specific configuration of a multi-mode filter.

A specific example filter is shown in FIG. 3A. In this example, the filter 300 includes a resonator body 310 made of 18 mm cubic ceramic body that has been silver coated on 5 sides, with the sixth side silvered in a thin band around the perimeter. The sixth side is soldered to a ground plane 321 on an upper side of a PCB 320, so that the coupling structure 330 is positioned against the un-silvered surface of the resonator body 310. Input and output lines on the PCB are implemented as coplanar transmission lines on an underside of the PCB 320 (not shown). It will therefore be appreciated that this arrangement is generally similar to that described above with respect to FIGS. 1A to 1E.

Figure 3B:
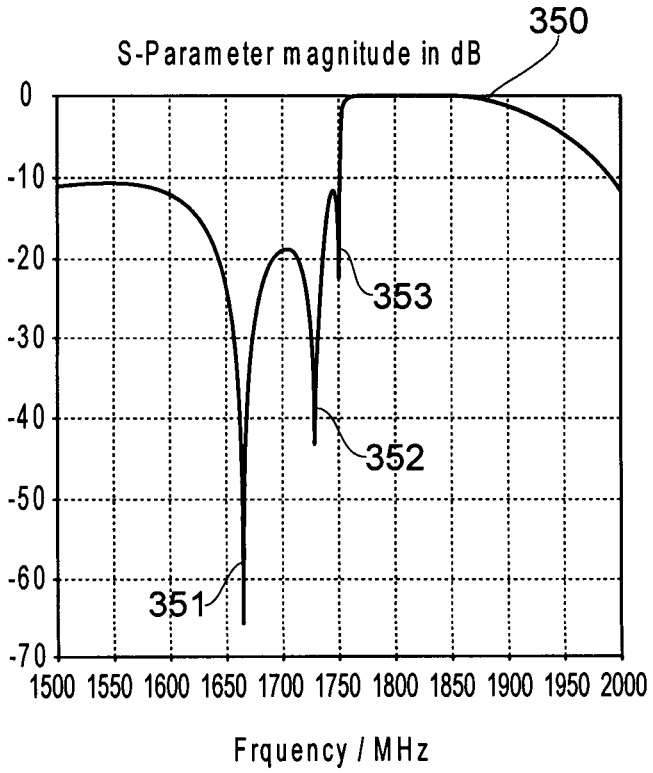
FIG. 3B is a graph of an example of the frequency response of the filter of FIG. 3A.

An example of a calculated frequency response for the filter is shown in FIG. 3B. As shown, the filter 100 can provide three low side zeros 351, 352, 353 adjacent to a sharp transition to a high frequency pass band 350. Alternatively, the filter 100 can provide three high side zeros adjacent to a sharp transition to a lower frequency pass band, described in more detail below with respect to FIG. 9B. When two filters are used in conjunction for transmission and reception, this allows transmit and receive frequencies to be filtered and thereby distinguished, as will be understood by persons skilled in the art.

Example coupling structures will now be described with reference to FIGS. 4A to 4F, together with an explanation of their ability to couple to different modes of a cubic resonator, thereby assisting in understanding the operation of the filter.

Traditional arrangements of coupling structures include a probe extending into the resonator body, as described for example in U.S. Pat. No. 6,853,271. In such arrangements, most of the coupling is capacitive, with some inductive coupling also present due to the changing currents flowing along the probe. If the probe is short, this effect will be small. Whilst such a probe can provide reasonably strong coupling, this tends to be with a single mode only, unless the shape of the resonant structure is modified. For a cubic resonator body, the coupling for each of the modes is typically as shown in Table 1 below.

TABLE 1

| Mode | H field coupling | E field coupling | Notes |
|---|---|---|---|
| TE 011 (E along X) | Negligible or zero due to tiny and orthogonal field. | Negligible or zero due to symmetry. | Negligible coupling |
| TE 101 (E along Y) | Negligible or zero due to tiny and orthogonal field. | Negligible or zero due to symmetry. | Negligible coupling |
| TM 110 (E along Z) | Some for long probe | strong | Strong coupling |

Furthermore, a probe has the disadvantage of requiring a hole to be bored into the cube.

Figure 4A:
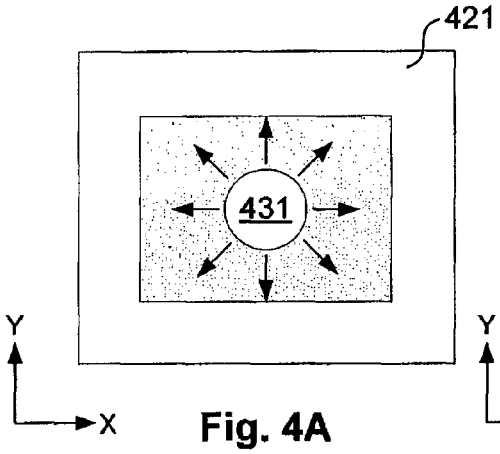
FIGS. 4A to 4F are schematic plan views of example conductive coupling paths.

An easier to manufacture (and hence cheaper) alternative is to use a surface patch, as shown for example in FIG. 4A, in which a ground plane 421 is provided together with a resonator 431. In this example, an electric field extending into the resonator body is generated by the patch, as shown by the arrows. The modes of coupling are as summarised in Table 2, and in general this succeeds in only weakly coupling with a single mode. Despite this, coupling into a single mode only can prove useful, for example if multiple resonators are to be provided on different surfaces to each couple only to a single respective mode. This could be used, for example, to allow multiple inputs and or outputs to be provided.

TABLE 2

| Mode | H field coupling | E field coupling | Notes |
|---|---|---|---|
| TE 011 (E along X) | none | Negligible or zero due to symmetry | Negligible coupling |
| TE 101 (E along Y) | none | Negligible or zero due to symmetry | Negligible coupling |
| TM 110 (E along Z) | none | Medium | Medium coupling |

Figure 4B:
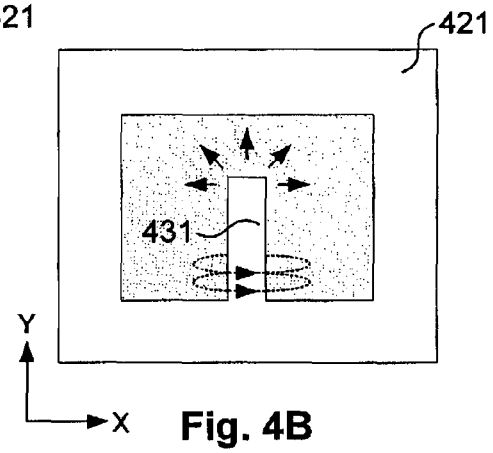

Coupling into two modes can be achieved using a quarter wave resonator, which includes a path extending along a surface of the resonator 431, as shown for example in FIG. 4B. The electric and magnetic fields generated upon application of a signal to the resonator are shown in solid and dotted lines respectively.

In this example, the resonator 431 can achieve strong coupling due to the fact that a current antinode at the grounded end of the resonator produces a strong magnetic field, which can be aligned to match those of at least two resonance modes of the resonator body. There is also a strong voltage antinode at the open circuited end of the resonator, and this produces a strong electric field which couples to the TM110 mode, as summarised below in Table 3.

TABLE 3

| Mode | H field coupling | E field coupling | Notes |
|---|---|---|---|
| TE 011 (E along X) | Weak or zero | Weak or zero | Negligible coupling |
| TE 101 (E along Y) | strong | Weak or zero | Strong coupling |
| TM 110 (E along Z) | strong | medium | Strongest coupling |

Figure 4C:
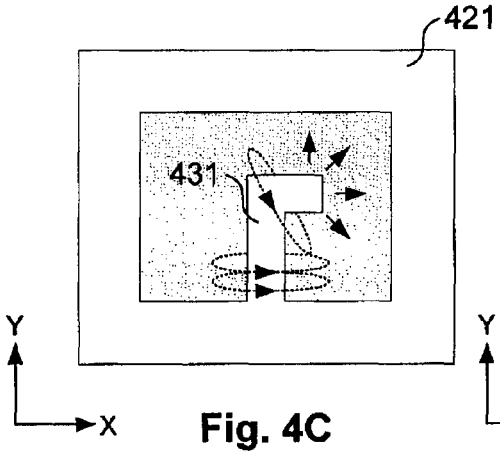

In the example of FIG. 4C, the resonator 431 includes an angled path, meaning a magnetic field is generated at different angles. However, in this arrangement, coupling to both of the TE modes as well as the TM mode still does not occur as eigenmodes of the combined system of resonator cube and input resonator rearrange to minimise the coupling to one of the three eigenmodes.

Figure 4D:
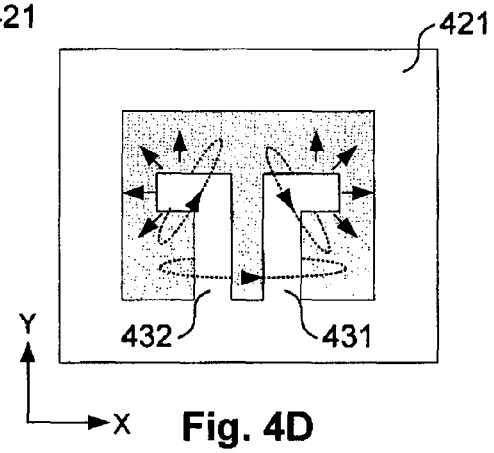

To overcome this, a second resonator 432 can be introduced in addition to the first resonator 431, as shown for example in FIG. 4D. This arrangement avoids minimisation of the coupling and therefore provides strong coupling to each of the three resonance modes. The arrangement not only provides coupling to all three resonance modes for both input and output resonators, but also allows the coupling strengths to be controlled, and provides further input to output coupling.

In this regard, the coupling between the input and output resonators 431, 432 will be partially magnetic and partially electric. These two contributions are opposed in phase, so by altering the relative amounts of magnetic and electric coupling it is possible to vary not just the strength of the coupling but also its polarity.

Figure 4E:
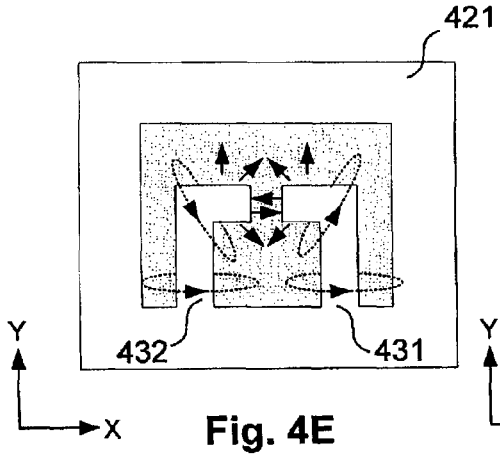

Thus, in the example of FIG. 4D, the grounded ends of the resonators 431, 432 are close whilst the resonator tips are distant. Consequently, the coupling will be mainly magnetic and hence positive, so that a filter response including zeros at a higher frequency than a pass band is implemented, as will be described in more detail below with respect to the receive band in FIG. 9B. In contrast, if the tips of the resonators 431, 432 are close and the grounded ends distant, as shown in FIG. 4E, the coupling will be predominantly electric, which will be negative, thereby allowing a filter with zeros at a lower frequency to a pass band to be implemented, similar to that shown at 350, 351, 352, 353 in FIG. 3B.

Figure 4F:
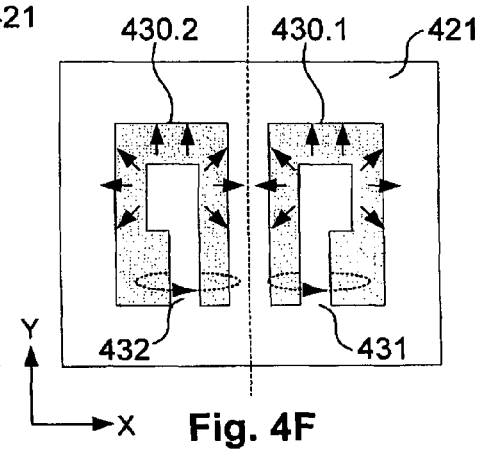

In the example of FIG. 4F, two coupling structures 430.1, 430.2 are provided on a ground plane 421, each coupling structure defining 430.1, 430.2 a respective resonator 431, 432. The resonators are similar to those described above and will not therefore be described in further detail. The provision of multiple coupling structures allows a large variety of arrangements to be provided. For example, the coupling structures can be provided on different surfaces, of the resonator body, as shown by the dotted line. This could be performed by using a shaped substrate, or by providing separate substrates for each coupling structure. This also allows for multiple inputs and/or outputs to be provided.

Figure 5:
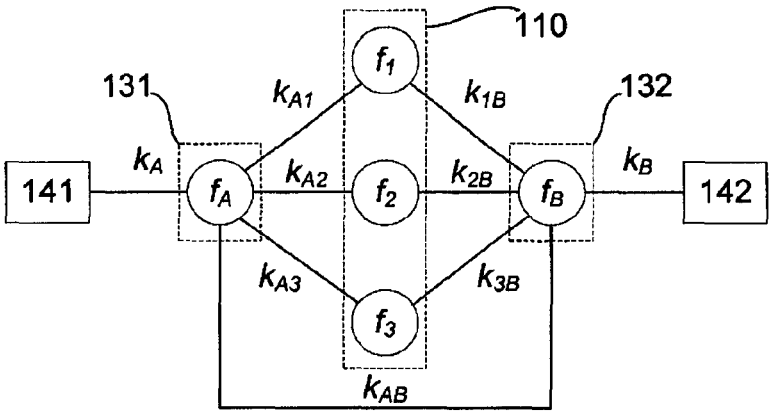
FIG. 5 is a schematic diagram of an example of a filter network model for the filter of FIGS. 1A to 1E.

In practice, the filter described in FIGS. 1A to 1E can be modelled as two low Q resonators, representing the input and output resonators 131, 132 coupled to three high Q resonators, representing the resonance modes of the resonator body 110, and with the two low Q resonators also being coupled to each other. An example filter network model is shown in FIG. 5.

In this example, the input and output resonators 131, 132 have respective resonant frequencies $f_A$, $f_B$, whilst the resonance modes of the resonator body 110 have respective resonant frequencies $f_1$, $f_2$, $f_3$. The degree of coupling between an input 141 and output 142 and the respective input and output resonators 131, 132 is represented by the coupling constants $k_A$, $k_B$. The coupling between the resonators 131, 132 and the resonance modes of the resonator body 110 are represented by the coupling constants $k_{A1}$, $k_{A2}$, $k_{A3}$, and $k_{1B}$, $k_{2B}$, $k_{3B}$, respectively, whilst coupling between the input and output resonators 131, 132 is given by the coupling constant $k_{AB}$.

It will therefore be appreciated that the filtering response of the filter can be controlled by controlling the coupling constants and resonance frequencies of the resonators 131, 132 and the resonator body 110.

In one example, a desired frequency response is obtained by configuring the resonator body 110 so that $f_1<f_2<f_3$ and the resonators 131, 132 so that $f_1<f_A$, $f_B<f_3$. This places the first resonator $f_1$ close to the desired sharp transition at the band edge, as shown for example at 353, 363 in FIG. 3B. The coupling constants $k_{A1}$, $k_{A3}$, $k_{1B}$, $k_{2B}$, $k_{3B}$, are selected to be positive, whilst the constant $k_{A2}$ is negative. If the zeros are to be on the low frequency side of the pass band, as shown for example at 351, 352, 353 and as will be described in more detail below with respect to the transmit band in FIG. 9B, the coupling constant $k_{AB}$ should be negative, while if the zeros are to be on the high frequency side as will be described in more detail below with respect to the receive band in FIG. 9B, the coupling constant $k_{AB}$ should be positive. The coupling constants $k_{AB}$, $k_{A1}$ generally have similar magnitudes, although this is not essential, for example if a different frequency response is desired.

Figure 6A:
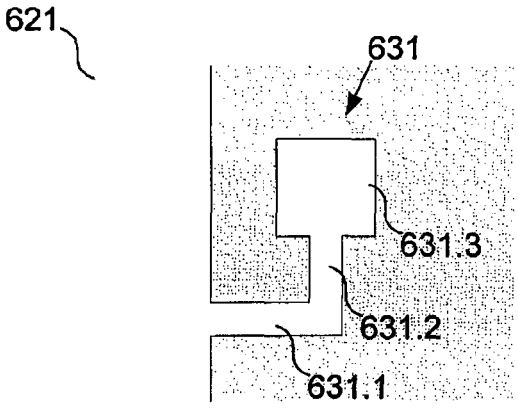
FIGS. 6A to 6C are schematic plan views of example conductive coupling paths illustrating how conductive coupling path configuration impacts on coupling constants of the filter.
Figure 6B:
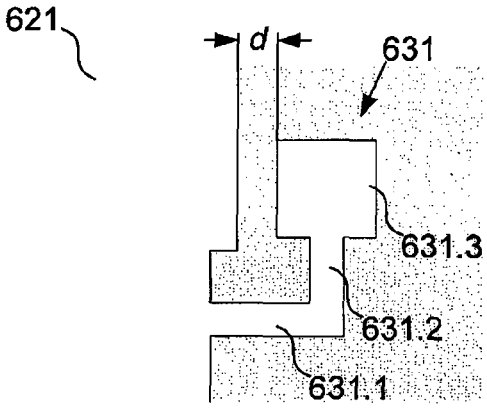
Figure 6C:
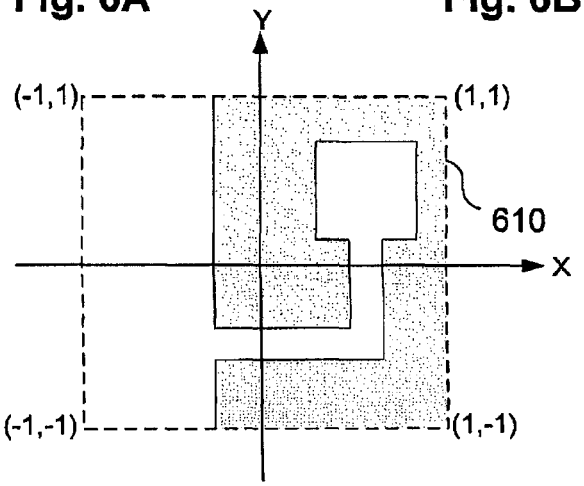

The strength of the coupling constants can be adjusted by varying the shape and position of the input and output resonators 131, 132, as will now be described in more detail with reference to FIGS. 6A to 6C.

For the purpose of this example, a single resonator 631 is shown coupled to a ground plane 621. The resonator 631 is of a similar form to the resonator 131 and therefore includes a first path 631.1 extending perpendicularly away from the ground plane 621, a second path 631.2 extending in a direction orthogonal to the first path 631.1 and terminating in a conductive resonator patch 631.3. In use, the first and second paths 631.1, 631.2 are typically arranged parallel to the axes of the resonator body, as shown by the axes X, Y, with the coordinates of FIG. 6C representing the locations of the resonator paths relative to a resonator body shown by the dotted lines 610, extending from (−1,−1) to (1,1). This is for the purpose of example only, and is not intended to correspond to the positioning of the resonator body in the examples outlined above. To highlight the impact of the configuration of the resonator 631 on the degrees of coupling reference is also made to the distance d shown in FIG. 6B, which represents the proximity of patch 631.3 to the ground plane 621.

In this example, the first path 631.1 is provided adjacent to the grounded end of the resonator 631 and therefore predominantly generates a magnetic field as it is near a current anti-node. The second path 631.2 has a lower current and some voltage and so will generate both magnetic and electric fields. Finally the patch 631.3 is provided at an open end of the resonator and therefore predominantly generates an electric field since it is near the voltage anti-node.

In use, coupling between the resonator 631 and the resonator body can be controlled by varying resonator parameters, such as the lengths and widths of the resonator paths 631.1, 631.2, the area of the resonator patch 631.3, as well as the distance d between the resonator patch 631.3 and the ground plane 621. In this regard, as the distance d decreases, the electric field is concentrated near the perimeter of the resonator body, rather than up into the bulk of the resonator body, so this decreases the electric coupling to the resonance modes.

Referring to the field directions of the three cavity modes shown in FIGS. 2A to 2C, the effect of varying the resonator parameters is as summarised in Table 4 below. It will also be appreciated however that varying the resonator path width and length will affect the impedance of the path and hence the frequency response of the resonator path 631. Accordingly, these effects are general trends which act as a guide during the design process, and in practice multiple changes in resonator frequencies and the degree of coupling occur for each change in coupling structure and resonator body geometry. Consequently, when designing a coupling structure geometry it is typical to perform simulations of the 3D structure to optimise the design.

TABLE 4

| Mode | Coupling Strength to Quarter Wave Resonator |
|---|---|
| TE 011 (E along X) | Maximum coupling when the first path 631.1 is long and at y = 0.<br>Negligible coupling from the second path 631.2.<br>Negligible coupling from the patch 631.3 when positioned at x = 0, y = 0. |
| TE 101 (E along Y) | Negligible coupling from the first path 631.1.<br>Maximum coupling when the second path 631.2 is long and at x = 0.<br>Negligible coupling from the patch 631.3 when positioned at x = 0, y = 0. |
| TM 110 (E along Z) | Maximum coupling when the first path 631.1 is long and at x = −1, y = 0.<br>Maximum coupling when the second path 631.2 is long and at x = 0, y = +1 or −1.<br>Maximum coupling when the patch 631.3 is large and at x = 0, y = 0.<br>Decreased coupling when the distance d is small. |

It will be appreciated from the above that a range of different coupling structure configurations can be used, and examples of these are shown in FIGS. 7A to 7E. In these examples, reference numerals similar to those used in FIG. 1D are used to denote similar features, albeit increased by 600.

Thus, in each example, the arrangement includes a resonator body 710 mounted on a substrate 720, having a ground plane 721. A coupling structure 730 is provided by a cut-out 733 in the ground plane 721, with the coupling structure including two resonators 731, 732, representing input and output resonators respectively. In this example, vias 722, 723 act as connections to an input and output respectively (not shown in these examples).

Figure 7A:
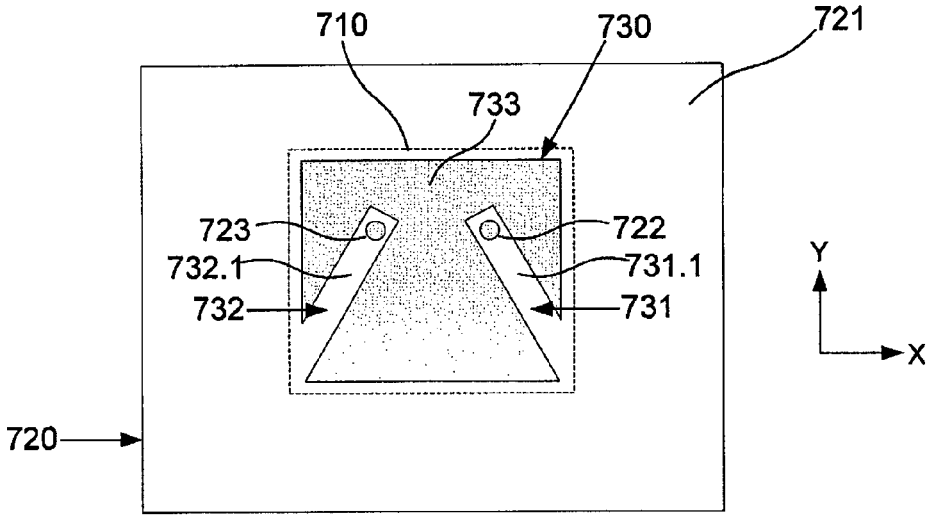
FIGS. 7A to 7E are schematic plan views of example of alternative coupling structures for the filter of FIGS. 1A to 1E.

In the example of FIG. 7A, the input and output resonators 731, 732 include a single straight resonator path 731.1, 732.1 extending from the ground plane 721 at an angle relative to the X, Y axes. This generates a magnetic field at the end of the path near the ground plane, with this providing coupling to each of the TE fields.

Figure 7B:
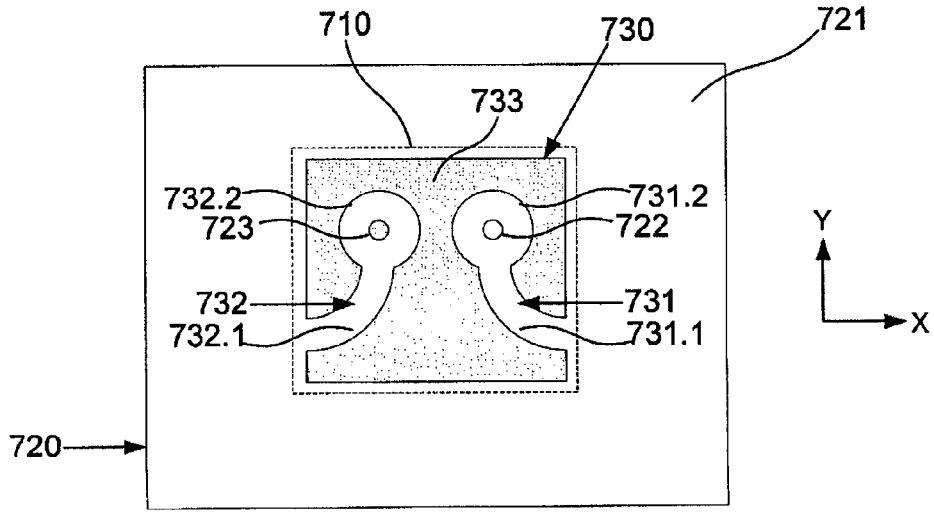

In the example of FIG. 7B, the input and output resonators 731, 732 include a single curved resonator path 731.1, 732.1 extending from the ground plane 721, to a respective resonator patch 731.2, 732.2. As shown the path extends a distance along each of the X, Y axes, so that magnetic fields generated along the path couple to each of the TE and TM modes, whilst the patch predominantly couples to the TM mode. It will be noted that in this example the patch 731.2, 732.3 has a generally circular shape, highlighting that different shapes of patch can be used.

Figure 7C:
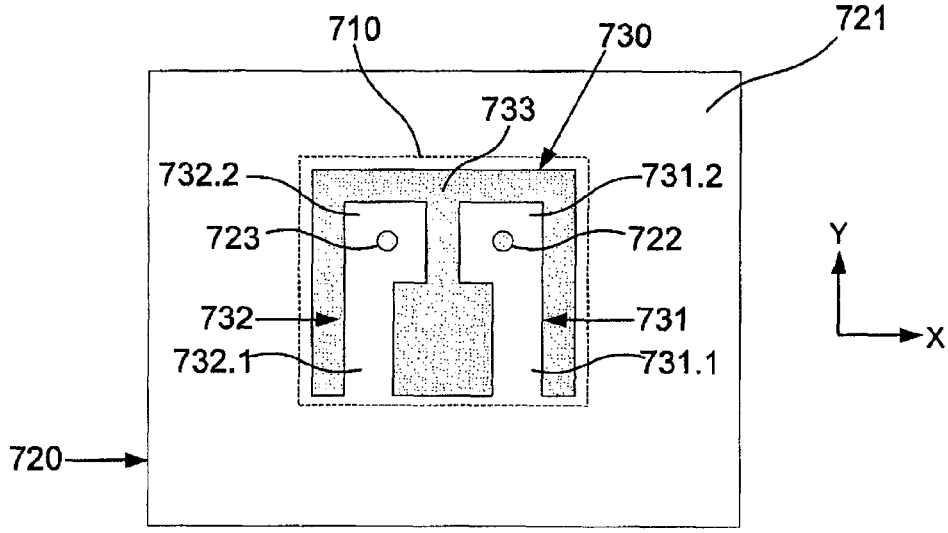
Figure 7D:
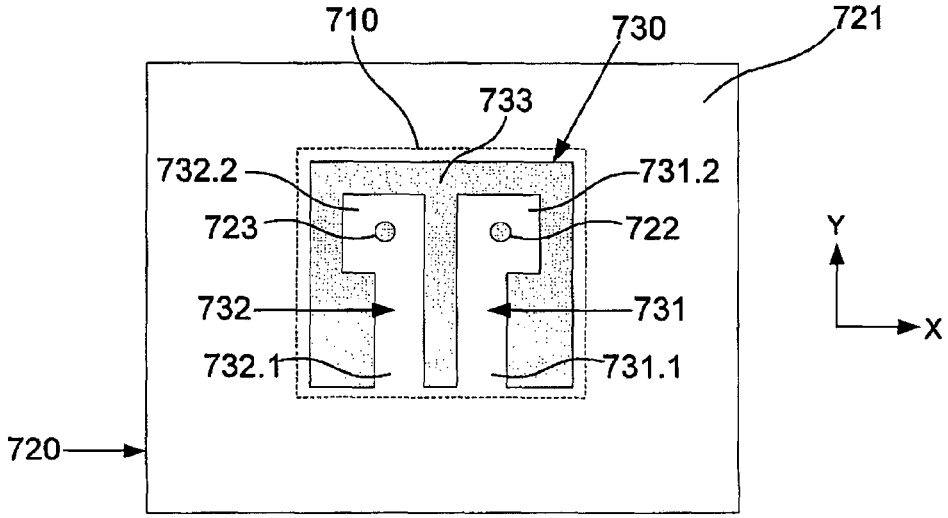

In the examples of FIGS. 7C and 7D, the input and output resonators 731, 732 include a single resonator path 731.1, 732.1 extending from the ground plane 721 to a patch 731.2, 732.2, in a direction parallel to an X-axis. The paths 731.1, 732.1 generate a magnetic field that couples to the TE101 and TM modes, whilst the patch predominantly couples to the TM mode.

In the example of FIG. 7D the grounded ends of the resonators 731.1, 732.1 are close whilst the resonator tips are distant. Consequently, the coupling will be mainly magnetic and so the coupling will be positive, thereby allowing a filter having high frequency zeros to be implemented. In contrast, if the tips of the resonators 731.1, 732.1 are close and the grounded ends distant, as shown in FIG. 7C, the coupling will be predominantly electric, which will be negative and thereby allow a filter with low frequency zeros to be implemented.

Figure 7E:
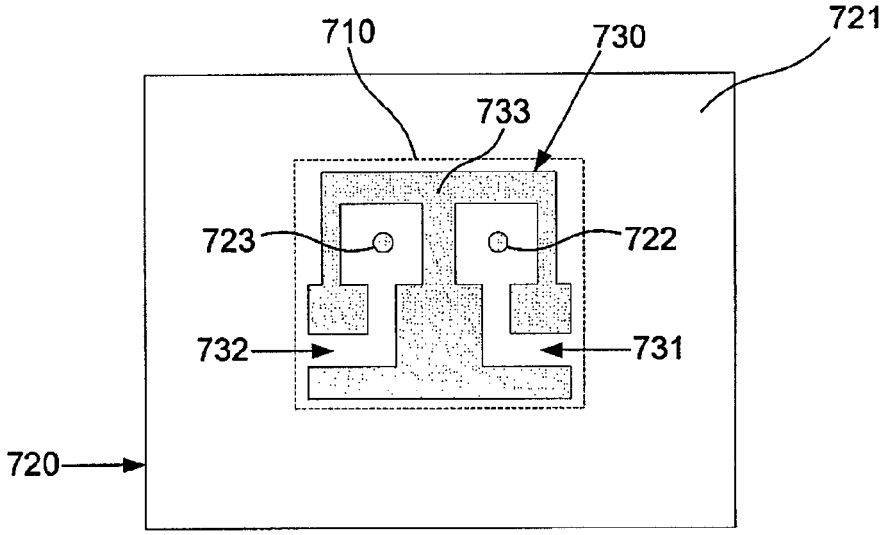

In the arrangement of FIG. 7E, this shows a modified version of the coupling structure of FIG. 1D, in which the cut-out 733 is modified so that the patch 731.3, 732.3 is nearer the ground plane, thereby decreasing coupling to the TM field, as discussed above.

In some scenarios, a single resonator body cannot provide adequate performance (for example, attenuation of out of band signals). In this instance, filter performance can be improved by providing two or more resonator bodies arranged in series, to thereby implement a higher-performance filter.

In one example, this can be achieved by providing two resonator bodies in contact with each other, with one or more apertures provided in the silver coatings of the resonator bodies, where the bodies are in contact. This allows the fields in each cube to enter the adjacent cube, so that a resonator body can receive a signal from or provide a signal to another resonator body. When two resonator bodies are connected, this allows each resonator body to include only a single resonator, with a resonator on one resonator body acting as an input and the resonator on the other resonator body acting as an output. Alternatively, the input of a downstream filter can be coupled to the output of an upstream filter using a suitable connection such as a short transmission line. An example of such an arrangement will now be described with reference to FIGS. 8A to 8E.

In this example, the filter includes first and second resonator bodies 810A, 810B mounted on a common substrate 820. The substrate 820 is a multi-layer substrate providing external surfaces 821, 825 defining a common ground plane, and an internal surface 824.

In this example, each resonator body 810A, 810B is associated with a respective coupling structure 830A, 830B provided by a corresponding cut-out 833A, 833B in the ground plane 821. The coupling structures 830A, 830B include respective input and output resonators 831A, 832A, 831B, 832B, which are similar in form to those described above with respect to FIG. 1D, and will not therefore be described in any detail. Connections 822A, 823A, 822B, 823B couple the resonators 831A, 832A, 831B, 832B to paths on the internal layer 824. In this regard, an input 841 is coupled via the connection 822A to the resonator 831A. A connecting path 843 interconnects the resonators 832A, 831B, via connections 823A, 822B, with the resonator 823B being coupled to an output 842, via connection 823B.

It will therefore be appreciated that in this example, signals supplied via the input 841 are filtered by the first and second resonator bodies 810A, 810B, before in turn being supplied to the output 842.

Figure 8A:
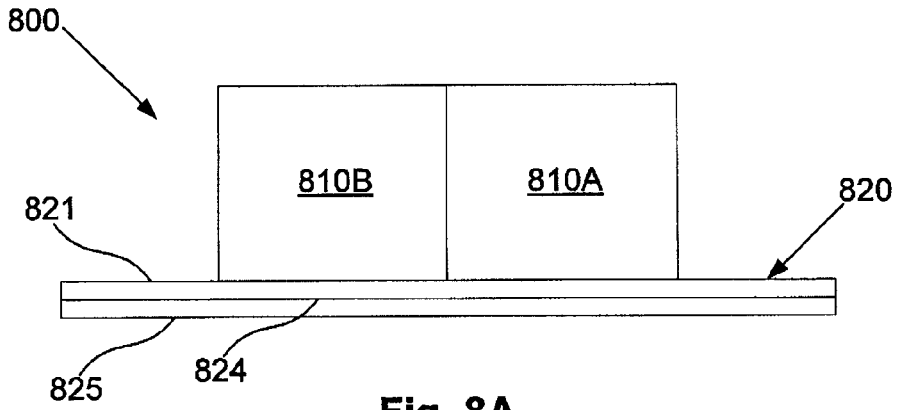
FIG. 8A is a schematic side view of an example of a multi-mode filter using multiple resonator bodies.
Figure 8B:
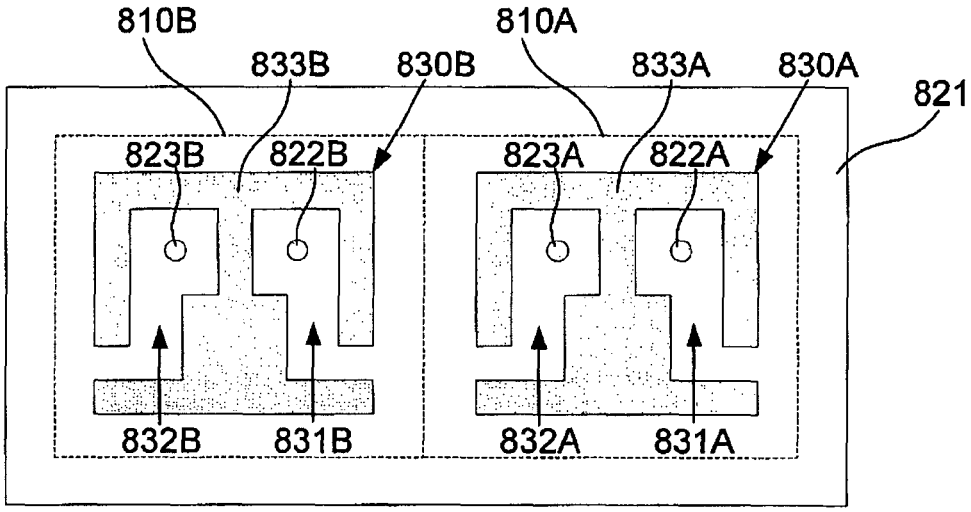
FIG. 8B is a schematic plan view of an example of the substrate of FIG. 8A including multiple coupling structures.
Figure 8C:
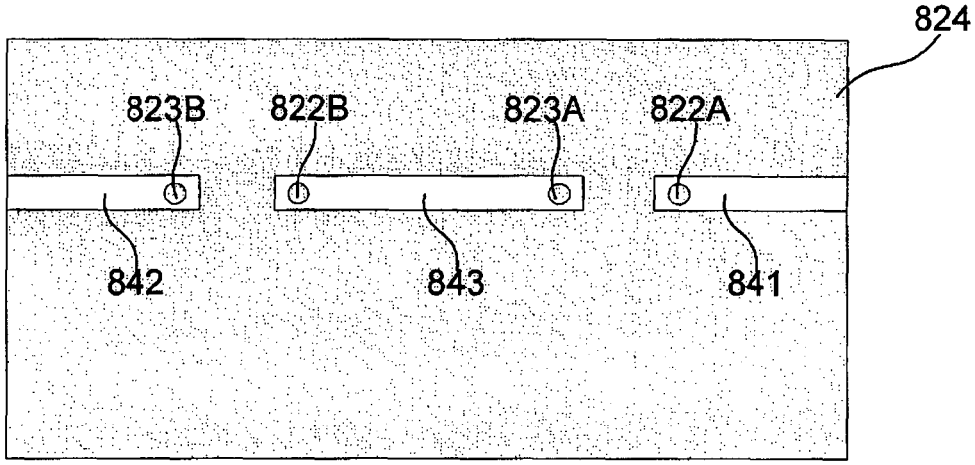
FIG. 8C is a schematic internal view of an example of the substrate of FIG. 8A including inputs and outputs.
Figure 8D:
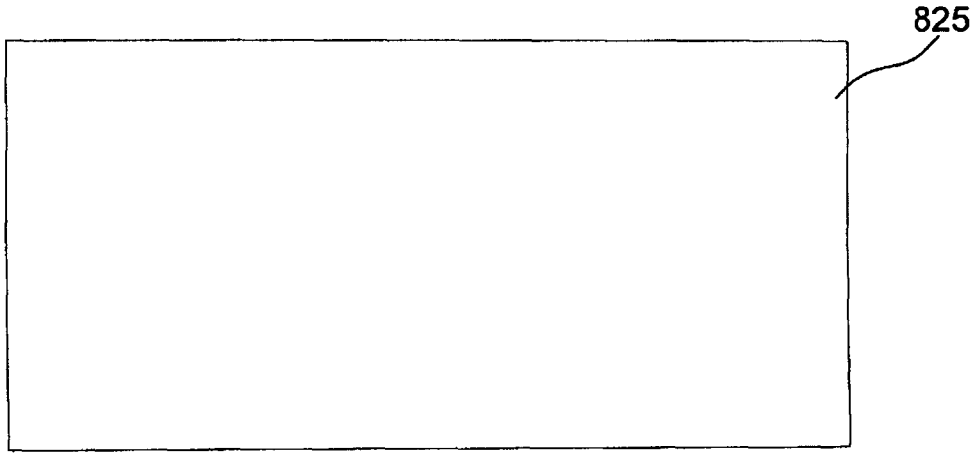
FIG. 8D is a schematic underside view of an example of the substrate of FIG. 8A.
Figure 8E:
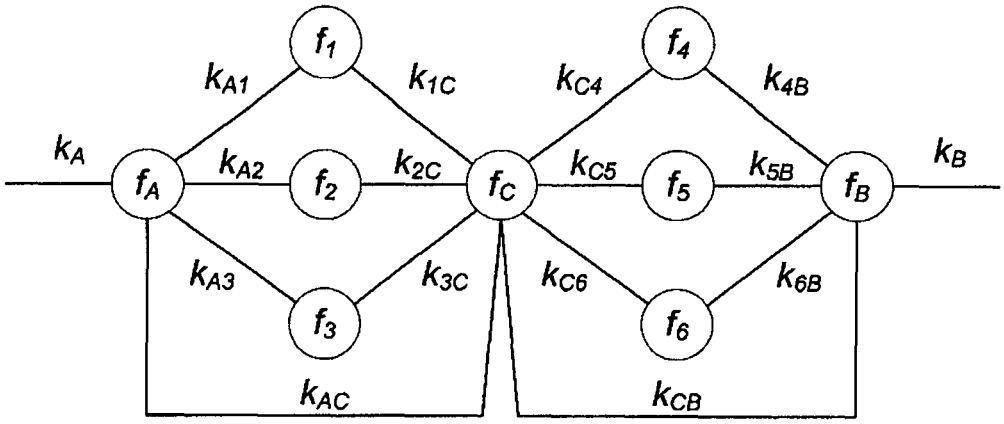
FIG. 8E is a schematic diagram of an example of a filter network model for the filter of FIGS. 8A to 8D.

In this arrangement, the connecting path 843 acts like a resonator, which distorts the response of the filters so that the cascade response cannot be predicted by simply multiplying the responses of the two cascaded filters. Instead, the resonance in the transmission line must be explicitly included in a model of the whole two cube filter. For example, the transmission line could be modelled as a single low Q resonator having frequency $f_C$, as shown in FIG. 8E.

Figure 9A:
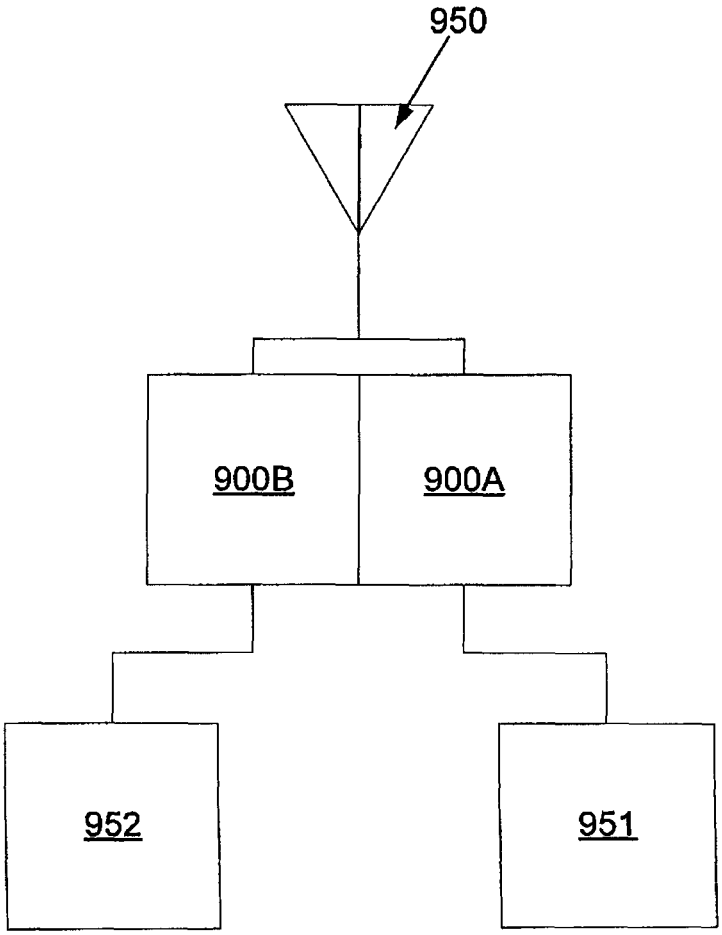
FIG. 9A is a schematic diagram of an example of a duplex communications system incorporating a multi-mode filter.

A common application for filtering devices is to connect a transmitter and a receiver to a common antenna, and an example of this will now be described with reference to FIG. 9A. In this example, a transmitter 951 is coupled via a filter 900A to the antenna 950, which is further connected via a second filter 900B to a receiver 952.

In use, the arrangement allows transmit power to pass from the transmitter 951 to the antenna with minimal loss and to prevent the power from passing to the receiver. Additionally, the received signal passes from the antenna to the receiver with minimal loss.

Figure 9B:
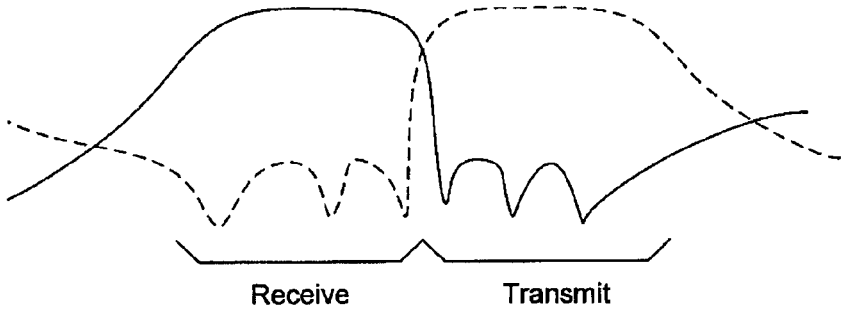
FIG. 9B is a schematic diagram of an example of the frequency response of the multi-mode filter of FIG. 9A.

An example of the frequency response of the filter is as shown in FIG. 9B. In this example, the receive band (solid line) is at lower frequencies, with zeros adjacent the receive band on the high frequency side, whilst the transmit band (dotted line) is on the high frequency side, with zeros on the lower frequency side, to provide a high attenuation region coincident with the receive band. It will be appreciated from this that minimal signal will be passed between bands. It will be appreciated that other arrangements could be used, such as to have a receive pass band at a higher frequency than the transmit pass band.

Figure 9C:
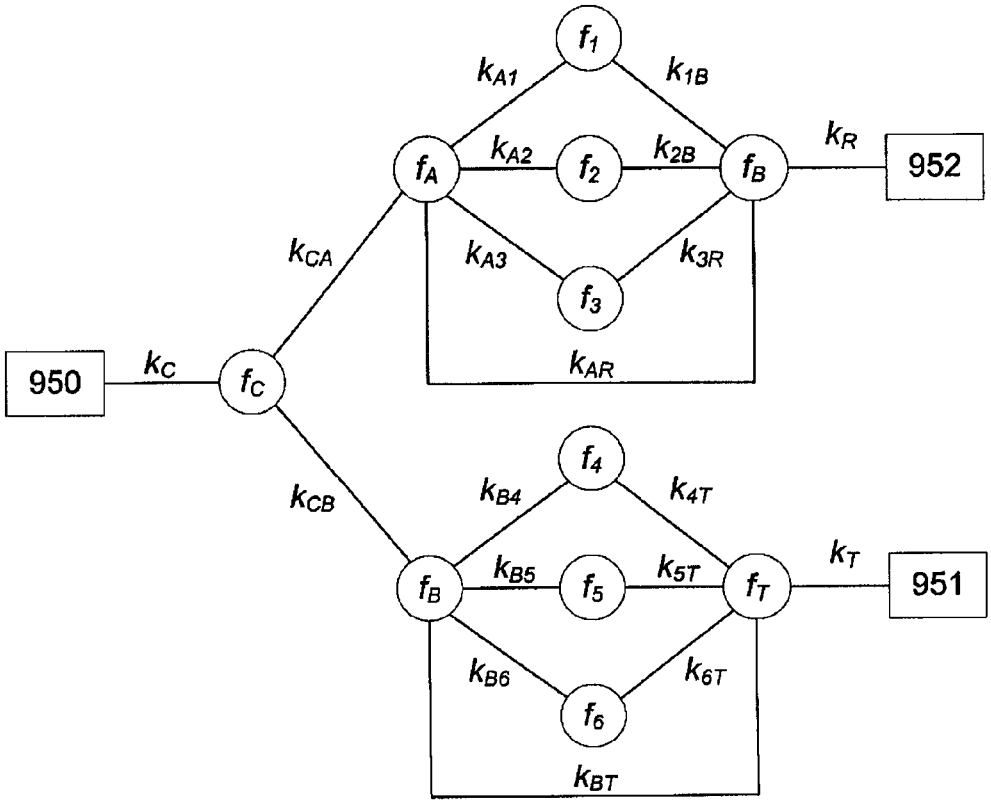
FIG. 9C is a schematic diagram of an example of a filter network model for the filter of FIG. 9A.

The duplexed filter can be modelled in a similar way to the single cube and cascaded filters, with an example model for a duplexer using single resonator body transmit and receive filters being shown in FIG. 9C. In this example, the transmit and receive filters 900A, 900B are coupled to the antenna via respective transmission lines, which in turn provide additional coupling represented by a further resonator having a frequency $f_C$, and coupling constants $k_C$, $k_{CA}$, $k_{CB}$, determined by the properties of the transmission lines.

Figure 10B:
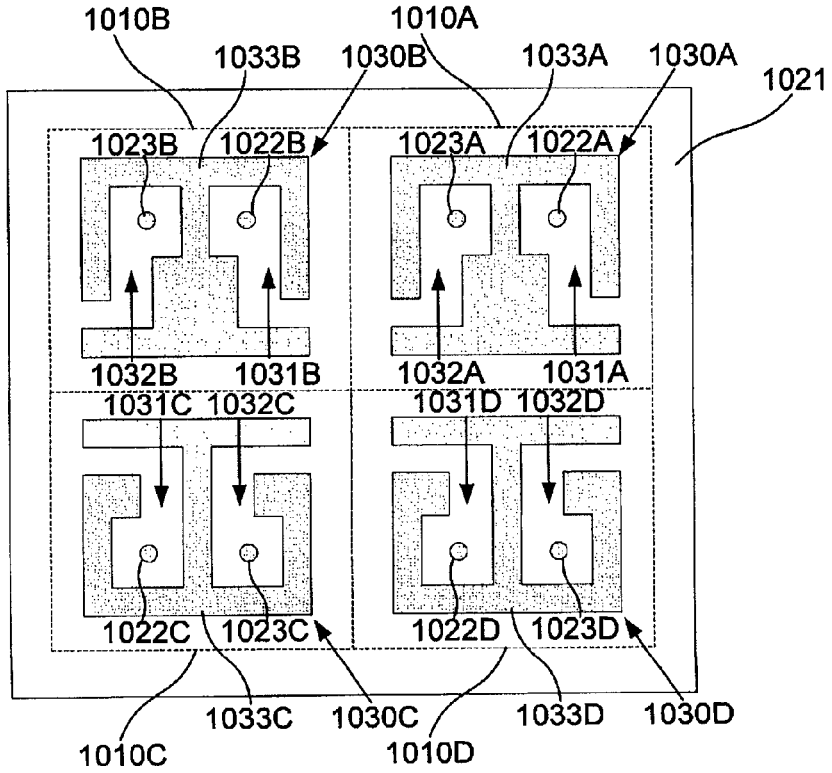
FIG. 10B is a schematic plan view of an example of the substrate of FIG. 10A including multiple coupling structures; and, FIG. 10C is a schematic underside view of an example of the substrate of FIG. 10A including inputs and outputs.
Figure 10C:
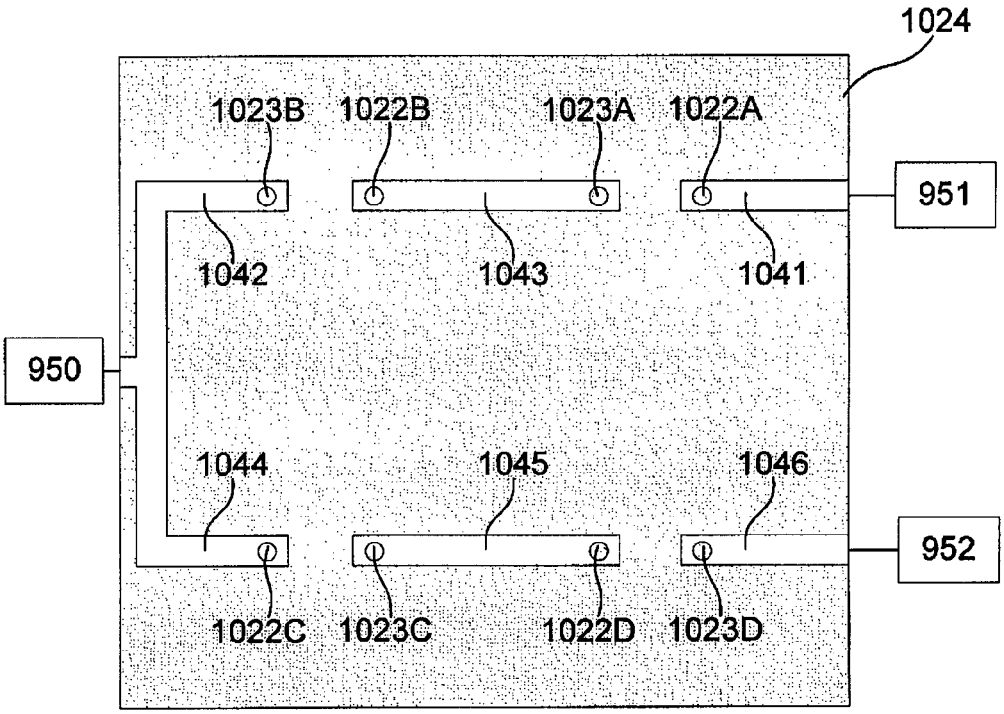

It will be appreciated that the filters 900A, 900B can be implemented in any suitable manner. In one example, each filter 900 includes two resonator bodies provided in series, with the four resonator bodies mounted on a common substrate, as will now be described with reference to FIGS. 10A to 10C.

In this example, multiple resonator bodies 1010A, 1010B, 1010C, 1010D can be provided on a common multi-layer substrate 1020, thereby providing transmit filter 900A formed from the resonator bodies 1010A, 1010B and a receive filter 900B formed from the resonator bodies 1010C, 1010D.

As in previous examples, each resonator body 1010A, 1010B, 1010C, 1010D is associated with a respective coupling structure 1030A, 1030B, 1030C, 1030D provided by a corresponding cut-out 1033A, 1033B, 1033C, 1033D in a ground plane 1021. Each coupling structure 1030A, 1030B, 1030C, 1030D includes respective input and output resonators 1031A, 1032A, 1031B, 1032B, 1031C, 1032C, 1031D, 1032D, which are similar in form to those described above with respect to FIG. 1D, and will not therefore be described in any detail. However, it will be noted that the coupling structures 1030A, 1030B, for the transmitter 951 are different to the coupling structures 1030C, 1030D for the receiver 952, thereby ensuring that different filtering characteristic are provided for the transmit and receive channels, as described for example with respect to FIG. 9B.

Connections 1022A, 1023A, 1022B, 1023B, 1022C, 1023C, 1022D, 1023D couple the resonators 1031A, 1032A, 1031B, 1032B, 1031C, 1032C, 1031D, 1032D, to paths on an internal layer 1024 of the substrate 1020. In this regard, an input 1041 is coupled via the connection 1022A to the resonator 1031A. A connecting path 1043 couples the resonators 1032A, 1031B, via connections 1023A, 1022B, with the resonator 1023B being coupled to an output 1042, and hence the antenna 950, via a connection 1023B. Similarly an input 1044 from the antenna 950 is coupled via the connection 1022C to the input resonator 1031C. A connecting path 1045 couples the resonators 1032C, 1031D, via connections 1023C, 1022D, with the resonator 1022D being coupled to an output 1046, and hence the receiver 952, via a connection 1023D.

Accordingly, the above described arrangement provides a cascaded duplex filter arrangement. The lengths of the transmission lines can be chosen such that the input of each appears like an open circuit at the centre frequency of the other. To achieve this, the filters are arranged to appear like 50 ohm loads in their pass bands and open or short circuits outside their pass bands.

It will be appreciated however that alternative arrangements can be employed, such as connecting the antenna to a common resonator, and then coupling this to both the receive and transmit filters. This common resonator performs a similar function to the transmission line junction above.

In addition to the desired, designed, filter response described above, it is also advantageous to consider spurious filter responses. These are unwanted 'peaks' in the stop-band characteristic, often occurring far from the pass-band, but which can cause problems in the practical application to which the filter is being applied. For example, a filter designed for the 900 MHz GSM/UMTS band could have a spurious response which allowed through appreciable energy in the 1.8 GHz PCS (GSM) band. This could have two consequences:

1. In the case of a 900 MHz band transmit filter (or the transmit part of a duplex filter), harmonics generated by the RF power amplifier in the transmitter could be passed through the filter and radiated from the antenna. These emissions could then interfere with the (unrelated) 1.8 GHz GSM transmissions, which may well be emanating from the same mast (and, quite possibly, from the same antenna, in the case of a dual-band antenna system). For this reason, there are typically strict limits placed upon these spurious emissions, for example within the ETSI standards. The transmit filter is required to play its part in meeting these emission limits and hence a 'peak' in its stop-band characteristic (in effect forming a spurious, additional, 'pass-band') is a significant problem.

2. In the case of a 900 MHz band receive filter (or the receive part of a duplex filter), the high-power 1.8 GHz transmissions from the mast (or the same antenna) could pass through (or be insufficiently attenuated by) a spurious filter response located in the downlink (base-station transmit) part of the 1.8 GHz band. A substantial signal level would then enter the receiver LNA and, whilst the LNA is not designed to amplify in this band, it will nevertheless experience overload, due to the high, unwanted, signal level at its input. This overload will cause 'blocking' to occur in the 900 MHz band receiver and prevent the receiver from meeting its full specification (e.g. sensitivity) and may even prevent operation altogether, or destroy the LNA's active device(s).

Consequently, embodiments of the present invention provide a method of tuning the spurious response characteristics of a multi-mode filter such that the spurious response may be placed where they are of no consequence to the application for which the filter has been designed. The method is both simple to implement (in a manufacturing environment) and low cost, both of which are advantageous requirements in a high-volume, low-cost application, such as within active antenna systems.

The basic concept of the further embodiments of the present invention is to introduce into the first dielectric material one or more regions that have a different dielectric constant, the added regions acting as tuning elements. The regions are introduced either by adding further pieces of a second dielectric material to the outside of, or in a recess into, the resonator body or forming closed air filled spaces on or in the resonator body. The size, shape, placement location and relative dielectric constant (relative to the dielectric constant of the first dielectric material of the resonator body) of these tuning elements enable the 'tuning' of the spurious responses to position the spurious responses without significantly impacting any of the wanted pass-band and stop-band/rejection characteristics of the filter.

Figure 11A:
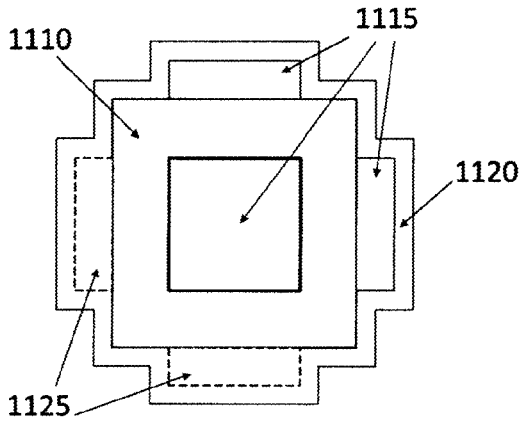
FIG. 11A is a schematic plan view of a resonator including tuning elements formed on the surface of the resonator body.

FIG. 11A illustrates a resonator body (in the example shown, in the shape of a cube) with tuning elements 1115 formed of pieces of a second dielectric material placed on the sides of the resonator body 1110. Note, however that the dielectric tuning elements may, theoretically, be placed on any surface of the resonator body (including the top and potentially even the bottom, although this latter location may prove problematic in practice. Further optionally added tuning elements 1125 are also indicated on FIG. 11A). The outer surface of the resonator body and attached tuning elements have a metal coating 1120. The tuning elements 1115 may be added before or after the resonator body 1110 is metallised. If before, then the resonator body and tuning elements are preferably coated with some low Er material and then overcoated with metal in a sequential firing or a co-firing process. If after, then the resonator body would be initially coated with metal with gaps in the metallisation to match the locations of the tuning elements 1115. The gaps may be cut or etched in the metal after the resonator body 1110 is completely coated, or the coating may be applied with deliberate gaps, for example by screen printing or a lithographic process. The gaps would then be covered by partly metallised tuning elements in such a way that the combined resonator body and tuning elements have a complete covering of metal. There should be substantially no metalisation between the added tuning elements and the resonator body itself, other than in some embodiments a minimal amount of metalisation around the periphery of the tuning element to facilitate soldering the tuning element to the rest of the resonator body.

Figure 11B:
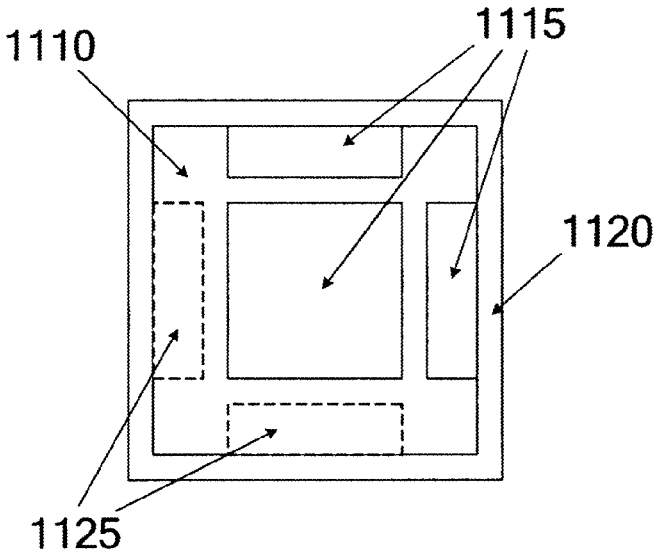
FIG. 11B is a schematic plan view of a resonator including tuning elements formed in recess's within the resonator body.

FIG. 11B shows an alternative placement of the added dielectric material. In this embodiment, the dielectric tuning elements 1115 are placed in recesses in the sides of the resonator body 1110 itself. This results in a near-cubic resonator, with no additional protrusions.

In embodiments of the present invention the tuning elements 1115 may be secured to the resonator body 1110 using a non-conductive adhesive (the dielectric properties/thickness of this adhesive may need to be taken into account within the design, depending upon its characteristics). In other embodiments the tuning elements may be mechanically secured adjacent to the resonator body. For example, the tuning elements may be pinned or stapled to the resonator body, or alternatively strapped to the resonator body using tightly-fitting metal straps, or the tuning elements and resonator body enclosed in a tightly-fitting metal box, the metal box being provided in place of the metal coating 1120, for example, or in addition to it.

Figure 11C:
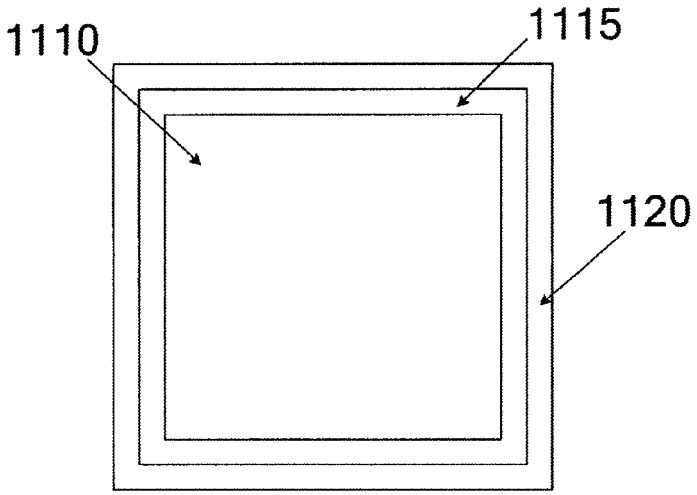
FIG. 11C is a schematic plan view of a resonator including a tuning element encapsulating the resonator body.

FIG. 11C illustrates an embodiment in which the tuning elements 1115 form an all-over coating of second dielectric material. This configuration is potentially simpler to manufacture than the case shown in FIG. 11B, although the tuning of the spurious responses is not as good.

The aim of a spurious tuning mechanism is to separate the unwanted spurious responses from the wanted passband and it is typically desirable to increase this separation as far as possible. A wide separation between the wanted and unwanted responses makes it easier for other circuitry (e.g. the power amplifier's output matching network or the LNA's input matching network) to provide sufficient additional attenuation to reduce unwanted emissions to an acceptable level. The 'best' spurious tuning mechanism is therefore one which is able to focus on moving the spurious responses without significantly impacting the wanted passband. Alternatively, if the spurious tuning mechanism does significantly impact the wanted passband (for example by shifting the passband frequency), this can be taken into account and compensated for during the design process such that the combination of the spurious tuning mechanism with the filter results in a passband at a desired frequency.

In the case of the embodiments of the present invention shown in FIG. 11A, the tuning elements 1115 do not cover the whole of a side of the resonator body 1110 and their influence is therefore concentrated at particular points. The field distribution in the resonator body 1110 shown in FIG. 11A is such that the higher order modes (i.e. those modes which generate the spurious responses) are concentrated in the central areas of each side, with the fundamental modes being more evenly distributed across the sides. Thus the placement of a different dielectric constant material covering only the central areas will have a much greater impact on the tuning of the higher order modes than it will on the fundamental modes (although it will still have some impact—the overall filter design, including the tuning elements, preferably takes account of this impact and seeks to ensure that the centre of the pass-band still sits at the desired frequency). For resonator bodies of different shapes the location on a face at which the field concentration is highest will vary depending on the shape, and therefore locating the tuning elements at the point of greatest field concentration will be desirable.

A low dielectric constant (relative to the dielectric constant of the resonator body) is preferred for the tuning material, since this will increase the resonant frequencies of the spurious responses and thereby move them further away from the fundamental (pass-band) frequency of the filter. However, it is also possible to tune the spurious responses using a high dielectric constant material (i.e. one higher than that of the resonator body). However this will move the spurious responses closer to those of the wanted passband and this is only useful where they can still be placed in a suitably 'safe' location (i.e. one in which the attached active circuitry generates no emissions, in the case of a transmitter, or has minimal susceptibility, in the case of a receiver). Another possibility is to have one or more tuning elements 1115 formed from a high dielectric constant material and the others formed from a low dielectric constant material so that some of the spurious modes moves down in frequency and the others up. Alternatively, one of or more of the tuning elements 1115 could be omitted. In preferred embodiments at least one tuning element is located on each available surface of the resonator body.

The above description of the operation of the tuning mechanism also serves to illustrate why an all-over covering of low dielectric material, as shown in FIG. 11C, whilst still having some beneficial impact on the spurious responses, is sub-optimal when compared with the smaller tuning elements shown in FIG. 11A. The all-over dielectric covering will have a significant impact upon the frequency of the fundamental modes as well as that of the spurious responses. It will still increase the separation of the fundamental and spurious responses, however this increase is not as marked as when using the smaller tuning elements of FIG. 11A.

In other embodiments the tuning elements are formed from hollow 'caps' of conductive material, such as pressed metal, that are soldered or otherwise bonded to the outer surface of the resonator body. The volume of air trapped within the caps has a different (lower) dielectric constant than the first dielectric material from which the remainder of the resonator body is formed and therefore has the same tuning effect as discussed above. Gases other than air may be used if desired. Alternatively, one or more recesses may be formed in the first dielectric material, as discussed above in relation to FIG. 11B, with each recess subsequently covered by a metal, or other conductive material, plate, thus creating a gas (air) filed void of different dielectric constant to the first dielectric material.

The impact of the coverage area, thickness and dielectric constant of the tuning elements is not crucial to their overall effect. It is possible to optimise the remaining parameters if one or more are fixed for whatever reason. For example, it is possible to choose a material for the tuning elements on the basis of cost, low-loss or ease of machining and then to select the coverage area and thickness of the tuning elements to produce the desired shift in the spurious responses of the filter. The size of the resonator body is also a variable in this process and will typically be used to return the frequency of the desired pass-band to the designed frequency, interactively with the size/thickness of the added tuning elements.

The shape of the tuning elements may also be varied as desired, with many options being possible, for example: thin cylinders (i.e. a cylinder with a small height relative to its diameter), a flat 'cube', a 'thick' rectangle, an arbitrary, flat shape, a cone, pyramid, or similar, a hemisphere or other spherically-derived shape with a flat surface, a flat triangular prism, an arbitrary 3-D shape (e.g. an amorphous 'blob'), so long as the shape can be accurately reproduced/manufactured.

In other embodiments multiple tuning elements may be used on each face of the resonator body to 'target' particular modes or groups of modes. Such targeting may be used to maximise the impact on a particular spurious response (for example) whilst minimising the impact on the fundamental mode (or even a 'useful' spurious mode). Additionally or alternatively, layered tuning elements, consisting of a number of layers of dielectric material, with each layer being of a different dielectric constant could, again, be used to target particular modes or groups of modes. They could also be used for simple, post-manufacturing 'tuning' of spurious responses, perhaps using very thin (e.g. 'paper thin') layers.

The precise location of the tuning elements is not critical with regards to the spacing between the fundamental and spurious resonant modes, with offsetting from the centre of a side being envisaged. In most cases, this is likely to be slightly sub-optimal, but it will still work.

Accordingly, the above described filter arrangements use a multimode filter described by a parallel connection, at least within one body. The natural oscillation modes in an isolated body are identical with the global eigenmodes of that body. When the body is incorporated into a filter, a parallel description of the filter is the most useful one, rather than trying to describe it as a cascade of separate resonators.

The filters can not only be described as a parallel connection, but also designed and implemented as parallel filters from the outset. The coupling structures on the substrate are arranged so as to controllably couple with prescribed strengths to all of the modes in the resonator body, with there being sufficient degrees of freedom in the shapes and arrangement of the coupling structures and in the exact size and shape of the resonator body to provide the coupling strengths to the modes needed to implement the filter design. There is no need to introduce defects into the body shape to couple from mode to mode. All of the coupling is done via the coupling structures, which are typically mounted on a substrate such as a PCB. This allows us to use a very simple body shape without cuts of bevels or probe holes or any other complicated and expensive departures from easily manufactured shapes.

The above described examples have focused on coupling to up to three modes. It will be appreciated this allows coupling to be to low order resonance modes of the resonator body. However, this is not essential, and additionally or alternatively coupling could be to higher order resonance modes of the resonator body.

Throughout the above examples, it is described that the coupling structures include resonators. However, it will be appreciated that in practice frequencies of signals applied to or provided from the resonators do not need to be at a resonant frequency of the resonator. The term resonator is not therefore intended to be limiting to any particular frequency relationship between the signals and the frequency response of the coupling structures.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. A dielectric resonator body for a multi-mode cavity filter, the resonator body comprising:

a piece of first dielectric material, said piece of first dielectric material having a substantially flat face for mounting said piece of first dielectric material on a substrate and a plurality of external sides in addition to said substantially flat face, the piece of first dielectric material having a first dielectric constant and a shape supporting at least a first resonant mode and a spurious response generated at least partially by a higher-order resonant mode of the first resonant mode;

at least one region of a second dielectric material, said at least one region of said second dielectric material being located on one of said plurality of external sides of said piece of first dielectric material and not covering all of said one of said plurality of external sides, said second dielectric material having a second dielectric constant different from said first dielectric constant; and a layer of conductive material at least partially coating an outer surface of said piece of first dielectric material and said at least one region of second dielectric material, said substantially flat face being substantially not covered by said layer of conductive material, whereby the presence of the at least one region of second dielectric constant alters the frequency separation between the first resonant mode and the spurious response.

2. The dielectric resonator body according to claim 1, wherein the second dielectric constant is lower than the first dielectric constant, whereby the frequency separation between the first resonant mode and the spurious response is increased.

3. The dielectric resonator body according to claim 1, wherein, the shape of the first dielectric material supports a plurality of resonant modes, said plurality of resonant modes including said first resonant mode.

4. The dielectric resonator body according to claim 3, wherein said at least one region of second dielectric material is located at an area of said one of said plurality of external sides of said piece of first dielectric material where the field distribution of the spurious response is more concentrated than that of the first resonant mode.

5. The dielectric resonator body according to claim 4, wherein the piece of first dielectric material is cuboid and said at least one region of second dielectric material is located at the center of said one of said plurality of external sides of said piece of first dielectric material.

6. The dielectric resonator body according to claim 1, wherein said at least one region of second dielectric material comprises a piece of second dielectric material secured adjacent to said one of said plurality of external sides of the piece of first dielectric material.

7. The dielectric resonator body according to claim 6, wherein the piece of second dielectric material protrudes from the surface of said one of said plurality of external sides of the piece of first dielectric material.

8. The dielectric resonator body according to claim 6, wherein the piece of second dielectric material is located within a recess formed in said one of said plurality of external sides of the piece of first dielectric material.

9. The dielectric resonator body according to claim 8, further comprising at least one piece of third dielectric material secured adjacent to the piece of second dielectric material, the second and third dielectric materials having different dielectric constants.

10. The dielectric resonator body according to claim 8, wherein the piece of second dielectric material is shaped as one of the following: a cylinder, a cuboid, a polyhedron, a portion of a sphere and a prism.

11. The dielectric resonator body according to claim 6, wherein the piece of second dielectric material is bonded to said one of said plurality of external sides of the piece of first dielectric material.

12. The dielectric resonator body according to claim 6, wherein the piece of second dielectric material is mechanically secured adjacent to said one of said plurality of external sides of the piece of first dielectric material.

13. The dielectric resonator body according to claim 1, wherein the at least one region of second dielectric material comprises a gas-filled space covered by said layer of conductive material.

14. The dielectric resonator body according to claim 13, wherein the gas-filled space is defined by at least one recess formed in said one of said plurality of external sides of the piece of first dielectric material.

15. The dielectric resonator body according to claim 13, wherein the gas-filled space is defined by at least one hollow shaped portion of said conductive material affixed to the surface of said one of said plurality of external sides of the piece of first dielectric material.

16. The dielectric resonator body according to claim 1, wherein the shape of said piece of first dielectric material further supports a second resonant mode and a second spurious response generated at least partially by a higher-order resonant mode of the second resonant mode, further comprising:

a second region of said second dielectric material, said second region of said second dielectric material being located on a second of said plurality of external sides of said piece of first dielectric material and not covering all of said second of said plurality of external sides, wherein said layer of conductive material at least partially coats an outer surface of said piece of first dielectric material, said at least one region of second dielectric material, and said second region of second dielectric material, whereby the presence of the second region of second dielectric constant alters the frequency separation between the second resonant mode and the second spurious response.

17. The dielectric resonator body according to claim 16, wherein the shape of said piece of first dielectric material further supports a third resonant mode and a third spurious response generated at least partially by a higher-order resonant mode of the third resonant mode, further comprising:

a third region of said second dielectric material, said third region of said second dielectric material being located on a third of said plurality of external sides of said piece of first dielectric material and not covering all of said third side of said plurality of external sides, wherein said layer of conductive material at least partially coats an outer surface of said piece of first dielectric material, said at least one region of second dielectric material, said second region of second dielectric material, and said third region of second dielectric material, whereby the presence of the third region of second dielectric constant alters the frequency separation between the third resonant mode and the third spurious response.

18. A method of manufacturing a dielectric resonator body for a multi-mode cavity filter, the method comprising:

providing a piece of first dielectric material, said piece of first dielectric material having a substantially flat face for mounting said piece of first dielectric material on a substrate and a plurality of external sides in addition to said substantially flat face, the piece of first dielectric material having a first dielectric constant and a shape supporting at least a first resonant mode and a spurious response generated at least partially by a higher-order resonant mode of the first resonant mode;

providing at least one region of a second dielectric material, said at least one region of said second dielectric material being located on one of said plurality of external sides of said piece of first dielectric material and not covering all of said one of said plurality of external sides, said second dielectric material having a second dielectric constant different from said first dielectric constant; and providing a layer of conductive material at least partially coating an outer surface of said piece of first dielectric material and said at least one region of second dielectric material, said substantially flat face being substantially not covered by said layer of conductive material, whereby the presence of the at least one region of second dielectric constant alters the frequency separation between the first resonant mode and the spurious response.

19. The method of claim 18, wherein the second dielectric constant is lower than the first dielectric constant, whereby the frequency separation between the first resonant mode and the spurious response is increased.

20. The method of claim 18, wherein the at least one region of second dielectric material comprises a piece of second dielectric material secured adjacent to said one of said plurality of external sides of the piece of first dielectric material.

21. The method of claim 20, wherein the piece of second dielectric material is bonded to the surface of said one of said plurality of external sides of the first dielectric material.

22. The method of claim 20, wherein the piece of second dielectric material is mechanically secured adjacent to said one of said plurality of external sides of the piece of first dielectric material.

23. The method of claim 20, wherein at least one recess is formed in said one of said plurality of external sides of the piece of first dielectric material and the piece of second dielectric material is located within the at least one recess.

24. The method of claim 20, wherein the step of providing the layer of conductive material includes:

providing said layer of the conductive material coating the piece of first dielectric material;

removing portions of the conductive layer at one or more locations; and adhering pieces of the second dielectric material to the piece of first dielectric material at said locations.

25. The method of claim 20, wherein the step of providing the layer of conductive material includes:

providing said layer of conductive material in a predefined pattern on the piece of first dielectric material, the predefined pattern including selected regions where no conductive material is provided; and securing pieces of the second dielectric material adjacent to the piece of first dielectric material at said selected regions.

26. The method of claim 25, wherein the pieces of the second dielectric material are partially coated in the conductive material prior to being secured adjacent to the piece of first dielectric material.

27. The method of claim 18, wherein the at least one region of second dielectric material is formed by creating at least one recess in said one of the plurality of external sides of the piece of first dielectric material prior to providing said layer of conductive material.

28. The method of claim 27, wherein the at least one recess is covered with a planar conductive element of said layer of conductive material.

29. The method of claim 18, wherein the at least one region of said second dielectric material is formed by affixing at least one hollow-shaped portion of the conductive material to the surface of said one of said plurality of external sides of the piece of first dielectric material.

* * * * *